US006497536B1

(12) United States Patent
Neilson et al.

(10) Patent No.: US 6,497,536 B1
(45) Date of Patent: Dec. 24, 2002

(54) ROOF SUPPORT ARRANGEMENT FOR MINING APPARATUS AND ROOF BOLTING EQUIPMENT

(75) Inventors: Brad Neilson, Gwynneville (AU); John R. Frederick, Polk, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 09/600,149

(22) PCT Filed: Jan. 12, 1999

(86) PCT No.: PCT/AU99/00014

§ 371 (c)(1),
(2), (4) Date: Jul. 12, 2000

(87) PCT Pub. No.: WO99/36671

PCT Pub. Date: Jul. 22, 1999

(30) Foreign Application Priority Data

Jan. 16, 1998 (AU) ..... PP1364
Jan. 19, 1998 (AU) ..... PP1399

(51) Int. Cl.[7] ..... E21D 20/00

(52) U.S. Cl. ..... 405/288; 405/272; 299/33; 173/32; 173/37

(58) Field of Search ..... 299/11, 33; 405/303, 405/288, 290, 291, 259.1, 259.6; 173/31, 32, 34, 37, 186

(56) References Cited

U.S. PATENT DOCUMENTS 4,056,203 A * 11/1977 Meldahl et al. ..... 214/75 T
4,079,792 A * 3/1978 Paul et al. ..... 173/23
4,290,490 A * 9/1981 Barthe et al. ..... 173/23
4,595,316 A * 6/1986 Tinnel ..... 405/291
4,640,369 A * 2/1987 Goyarts ..... 173/42
4,753,299 A * 6/1988 Meyers ..... 172/777
4,953,914 A * 9/1990 LeBegue ..... 299/11
5,016,942 A * 5/1991 Spross et al. ..... 299/33
6,325,460 B1 * 12/2001 Frederick ..... 299/12

* cited by examiner

*Primary Examiner*—David Bagnell
*Assistant Examiner*—Daniel P Stephenson
(74) *Attorney, Agent, or Firm*—James Earl Lowe, Jr.

(57) ABSTRACT

The invention provides an apparatus (2) for installing bolts into a mine entry, said apparatus including: a frame (8) having a forward end (20), a rearward end and lateral sides; at least one bolting rig (140, 142, 144, 146) operatively mounted to said forward end of said frame; at least one roof support member attached to said forward end of said frame (8) separate from said bolting rig (140, 142, 144, 146) for selectively supporting said mine entry as bolts are installed therein; and an operator station (990) on said frame for supporting an operator thereon during operation of said at least one roof support member.

17 Claims, 33 Drawing Sheets

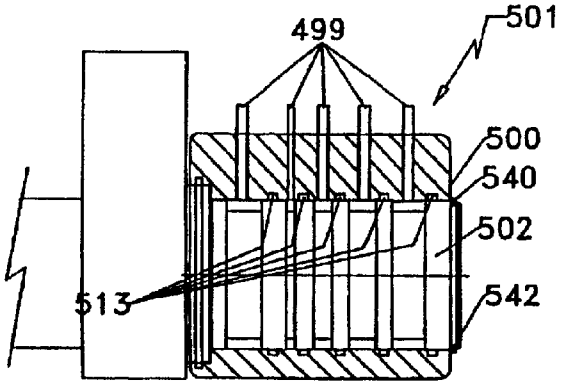
FIGURE 29
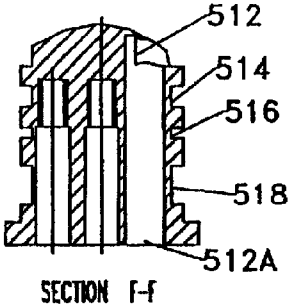
FIGURE 37
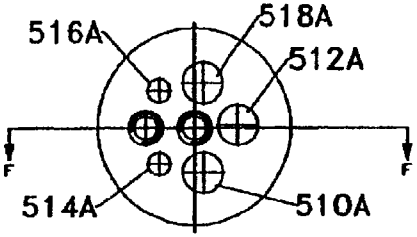
FIGURE 36
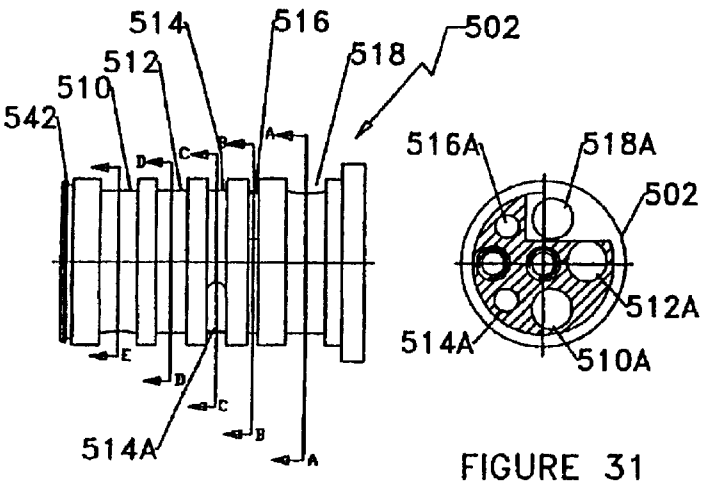
FIGURE 30
FIGURE 31
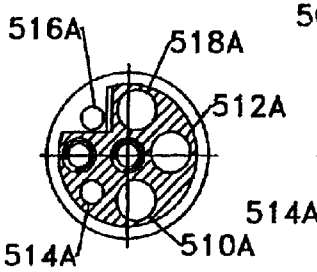
FIGURE 32
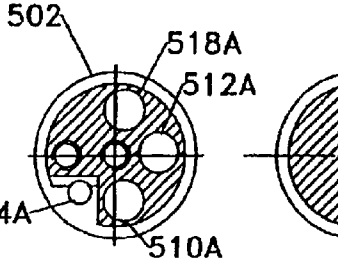
FIGURE 33
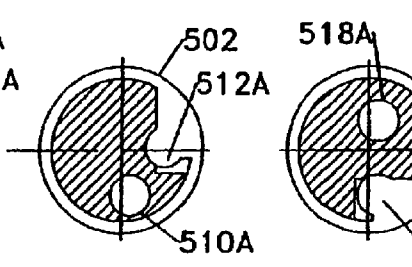
FIGURE 34
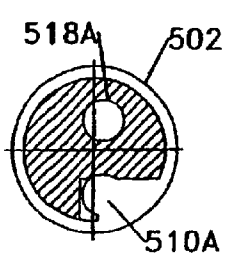
FIGURE 35

ROOF SUPPORT ARRANGEMENT FOR MINING APPARATUS AND ROOF BOLTING EQUIPMENT

FIELD OF THE INVENTION

The present invention relates to the improvements in mining apparatus and more particularly to improvements in roof bolting equipment.

BACKGROUND OF THE INVENTION

Perhaps the single most important consideration and challenge facing miners and mining engineers since the inception of underground mining involves the need to prevent the collapsing of the overhead ceilings or roofs and side walls ("ribs") of mines to prevent injury to personnel and catastrophic damage to mining equipment.

Roof bolting and rib bolting are those processes which secure the ribs, side walls and roofs of mines to other stable strata. These processes are relatively slow and are the main causes for preventing mines from advancing at a faster rate.

A currently acceptable method for supporting the roof of a mine entry involves drilling holes at predetermined intervals into the ceiling and ribs and installing elongated retaining bolts in the holes. Such bolts are commonly used in connection with retaining plates and support members. Such apparatus serves to secure together thin strata or bands of rock located adjacent the ribs and roofs and prevent lateral shifting of the strata, as well as, in some instances, to anchor the strata to more massive overlying rock. The installation of retaining bolts into the roof of a mine additionally requires the use of temporary roof support cylinders to support the roof as the bolt holes are being drilled. The reader will appreciate that during the initial engagement between the temporary cylinders and the unsupported section of roof, the condition exists for causing portions of the unsupported roof to fall. Thus, it is desirable for the operation personnel to be as far away from such apparatus as practical during its initial installation.

Over the years, a variety of different types of apparatuses have been developed for installing retaining bolts into the roof and ribs of a mine. An early roof bolting drill is disclosed in U.S. Pat. No. 2,771,273 to Pond. That device comprises an electrical powered drill assembly that is adapted to be manually pulled throughout the mine. Such device offers little protection from roof falls and falling debris during bolt installation.

In an effort to increase the speed of roof bolting, one prior art track mounted roof bolting apparatus was developed, known as the REMB (rapid entry mobile bolter) and was discussed and published in World Mining Equipment April 1997 issue (published by Independent Editorial and Technical Services of the UK). The REMB provides four vertically oriented roof bolting rigs on a forward moveable and raiseable carriage and work platform which is connected to a platform mounted above a track vehicle and which remains stationary relative to the track vehicle. The roof bolting work platform is connected to the stationary platform by a passageway and a series of steps. The bolting carriage and the work platform are attached to the track vehicle by a complex parallel linkage arrangement to the front of the vehicle, so as to keep the rigs at a 90° degree angle at all times to the tracks as carriage, work platform and the rigs move up or down. The machine also includes a rib bolt rig behind each operator, which are mounted on the lower stationary platform. The bolting rigs are in a forward position relative to the two operators.

While the REMB has improved the speed of mining, it is not fast enough for many mining applications. One reason for this is the fact that the rib bolters are positioned on the platform which is stationary relative to track vehicle, and this platform is a separate platform from the platform where the operator will control and operate the four roof bolters. This causes several difficulties. The first is that there is a risk of injury for the operators to move up and down steps on platforms, particularly when the steps and the platforms may have water falling thereon making surfaces slippery, even if expanded metal mesh is provided.

The second difficulty relates to the fact that the operators have a bolting down-time as they move from the roof bolting platform to the rib bolting platform.

The REMB also inherently requires the double handling of the consumables as the operator must move a supply of the consumables to the roof bolting platform from the storage area on the REMB, to an area accessible by the operator on the roof bolting platform. This will entail the regular walking up and down of steps to and from the roof bolting platform.

Other prior art roof bolting apparatus mount bolting rigs onto swingable booms. Such equipment however generally form crush points which are hazardous to operators.

A continuous mining machine normally includes a rotatable cutting drum that is mounted on the front end of the mining machine. As the mining machine is advanced into the seam, the cutting drum dislodges or "wins" the coal from the seam. In most continuous mining machines of this type, the won material is conveyed rearwardly of the cutting drum by a longitudinally extending conveyor that may discharge into self-propelled shuttle cars or other mobile conveying apparatuses to transport the won material from the mine face. The mining machine continuously advances into the seam and, as the material is won therefrom, an "entry" is formed in the underground seam.

While some continuous mining equipment such as that disclosed in U.S. Pat. No. 4,655,507, published and issued on Apr. 7 1987, have multiple roof bolting rigs mounted thereon, they invariably have a series of roof bolters and rib bolters mounted thereon to provide the full range of roof bolting facilities. However, such equipment can have the same disadvantages as the REMB has due to similar construction features. The continuous miners may have some four operators working to maintain the speed of roof bolting, but the use of two additional operators is a very costly solution to the speed requirements.

Other retaining bolt installation apparatuses are adapted to be affixed to a continuous mining machine for travel therewith U.S. Pat. No. 3,493,058 to Zitko and U.S. Pat. No. 4,953,914 to LaBegue disclose such devices which can be operated by personnel located on the mining machine. While such apparatus do not require the mining machine to be removed from the entry while bolts are being installed, the mining process is, nonetheless, typically interrupted during the bolting process.

In the cut and flit method of mining, a continuous miner first proceeds down one road, it must then reverse out and turn down a second road and cut that road while a specialised roof bolter bolts in the first mentioned road. The bolter and the continuous miner are continually swapping their roadway positions as the mine face moves forward. The speed of moving forward however is generally limited to the speed of inserting bolts into the ribs and roof of the mine.

SUMMARY OF THE INVENTION

The present invention provides an apparatus for installing bolts into a mine entry, said apparatus including: a frame having a forward end, a rearward end and lateral sides; at least one bolting rig operatively mounted to said forward end of said frame; at least one roof support member attached to said forward end of said frame separate from said bolting rig for selectively supporting said mine entry as bolts are installed therein; and an operator station on said frame for supporting an operator thereon during operation of said at least one roof support member.

Preferably the apparatus further includes: a pair of drive units on opposite sides of the frame for carrying and moving the frame; a pivot assembly connecting the rearward end of the frame to each of the drive units, the pivot assembly defining a pivot axis which is generally horizontal, the frame being pivotable relative to said drives about said pivot axis; the at least one bolting rig adapted to be raised and lowered by pivoting the frame relative to the drive units about the pivot axis.

The apparatus can further include in a line across it, at least one central bolting rig and at least two side bolting rigs on opposite sides of the central bolting rig, the side bolting rigs being rotatable from a generally vertical orientation through a range of intermediate orientations to a generally horizontal outwardly facing orientation which allows for both roof and rib bolting by the side bolting rigs.

Preferably the side bolting rigs are mounted on opposed laterally extendible frames, which have at least one laterally extendible telescoping cylinder for moving each said side bolting rig.

The can be included a pair of side by side central bolting rigs each of which is independently rotatable between inclined and vertical positions.

The apparatus can also include at least one removable storage container supported on said frame and at least one deck extension platform pivotally attached to at least one said lateral side of said frame and being pivotable from a first position wherein each said deck extension protrudes laterally from said corresponding lateral side and is generally coplanar therewith and a second generally upright position. The deck extension platform can be pivoted between said first position and said second position by at least one hydraulic cylinder.

The frame can have a push blade operably attached to the forward end thereof.

The bolting rig is able to rotate through a range of angles from approximately 10° in an inward direction from vertical, through angles from the vertical to the horizontal, to approximately 20° below the horizontal, so that the included angle in the range is approximately 120°.

An operator station can be included on said frame for supporting an operator thereon during operation of the apparatus, said operator station being located at a position remote from said at least one bolting rig to define a work area therebetween, and a planar deck member attached to said frame and covering said work area for supporting an operator thereon, with the operator station being at least 1.5 meters away from said at least one support member.

There is preferably provided a cable reel operably attached to said frame for selectively storing and paying out power cable attached between said apparatus and a power source.

At least one bolting rig can be pivotable between a generally vertical position and a generally horizontal position and wherein said bolting rig can install bolts into a rock face in either of those two positions and in any selected intermediate position therebetween.

The frame preferably carries, at its forward end, an upstanding bolting rig support wall, a guide frame being mounted to said support wall, said bolting rig being movably supported on said guide frame and adapted to be selectively moved laterally along said guide frame parallel to said support wall.

The roof support member can include a dual acting hydraulic cylinder arranged to engage the roof and floor of said entry and extend therebetween to support said entry and retain said frame in position during operation of the bolting rig.

Each bolting rig can have a control station associated therewith and is independently operable by means of said control station.

BRIEF DESCRIPTION OF THE DRAWINGS

Embodiments of the invention will now be described, by way of example only, with reference to the accompanying drawings in which:

FIG. 29 illustrates a rotary joint of FIG. 28 with the manifold and pin in cross section;

FIG. 30 illustrates a plan view of a distribution pin for a rotary joint for use with the apparatus of FIG. 28;

FIG. 31 illustrates a cross section through the line A—A of FIG. 30;

FIG. 32 illustrates a cross section through the line B—B of FIG. 30;

FIG. 33 illustrates a cross section through the line C—C of FIG. 30;

FIG. 34 illustrates a cross section through the line D—D of FIG. 30;

FIG. 35 illustrates a cross section through the line E—E of FIG. 30;

FIG. 36 illustrates a rear elevation of the pin of FIG. 29;

FIG. 37 illustrates a cross section through the line F—F of FIG. 36;

DETAILED DESCRIPTION OF THE EMBODIMENTS

Figure 1:
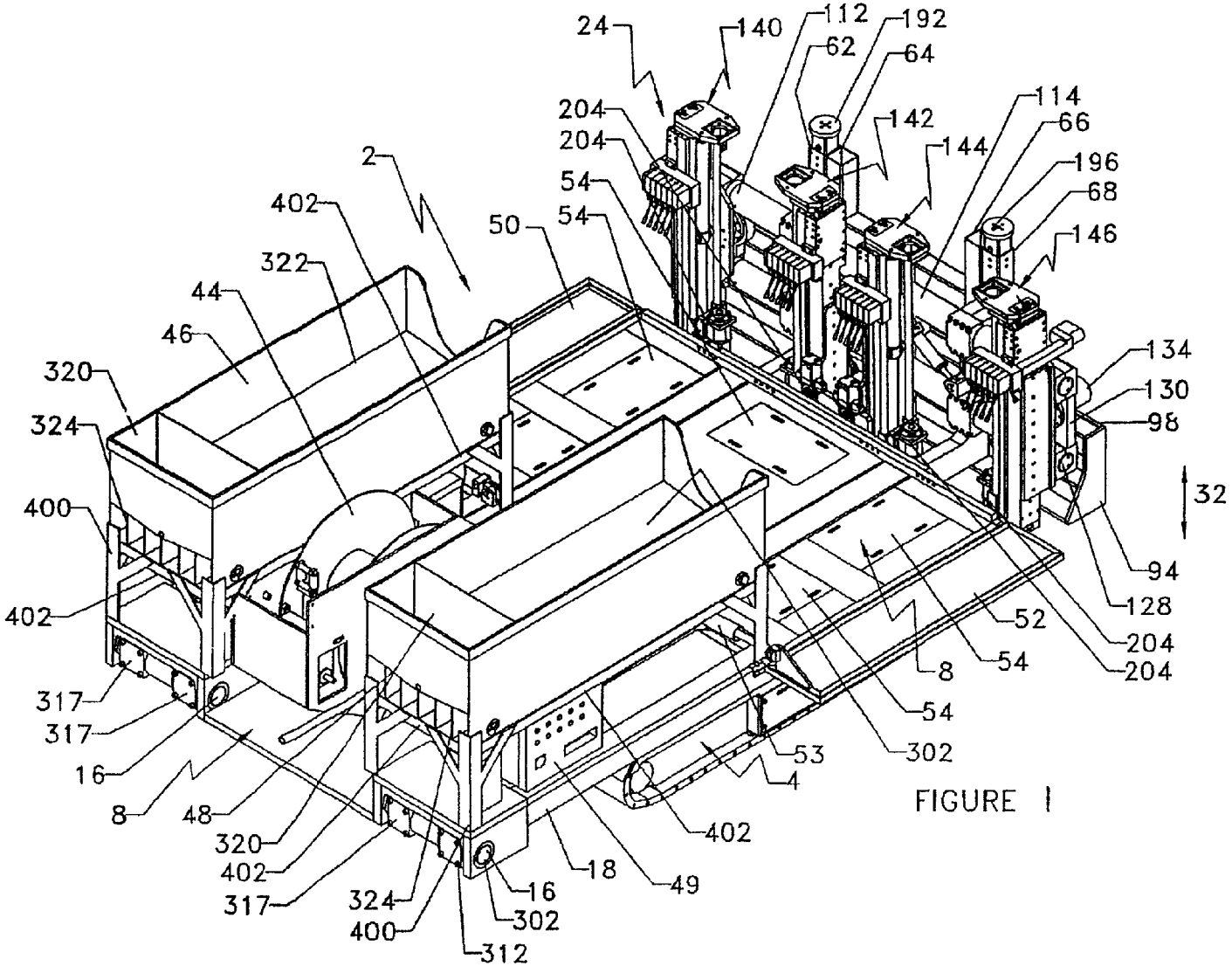
FIG. 1 illustrates a perspective view of a fully assembled mobile, pivoted platform bolting apparatus.

Illustrated in FIGS. 1 to 9 is a track mounted rear pivoted bolter 2 which has two track units 4 and 6. The track units 4 and 6 have a relatively shallow track assembly height. The track units 4 and 6 are each independently linked to a platform assembly 8 and are not constructed as part of a chassis to form a rigid undercarriage.

Illustrated in FIGS. 1 to 9 are various views of the assembled bolting apparatus 2. Many of these features will be described in detail later, but for overview purposes some salient features illustrated in FIGS. 1 to 9 will now be described.

The bolter 2 as illustrated in each of FIGS. 1 to 4 includes two materials pods 46 and 48 mounted on the rear of the platform assembly 8, in a raised location. As will be seen in FIG. 4, the maximum height of the pods 46 and 48 is below the top plates 141 of the timber jacks of the bolting rigs 140,142,144,146. The frames holding the pods 46 and 48 are made of angle iron posts 400, as will be described later. These frames are more clearly illustrated in FIGS. 5 and 6, which have the pods 46 and 48 removed.

Under the pod 46 is located a power pack 42, and adjacent thereto, but not under the pod 46, is a modular cable reel assembly 44. Housed under the location of the pod 48 is a circuit breaker box and master station 49 for the electronic control systems.

Located between the pods 46 and 48 is a station 990 for the operators to control and drive the bolter 2 moves from location to location. The station 990 can also include the controls to tilt the platform assembly 8 relative to the track units 4 and 6. If desired the station 990 can include a canopy, (as illustrated in FIGS. 39 to 43) to protect the operators while the bolter 2 is moving in a mine entry.

Figure 4:
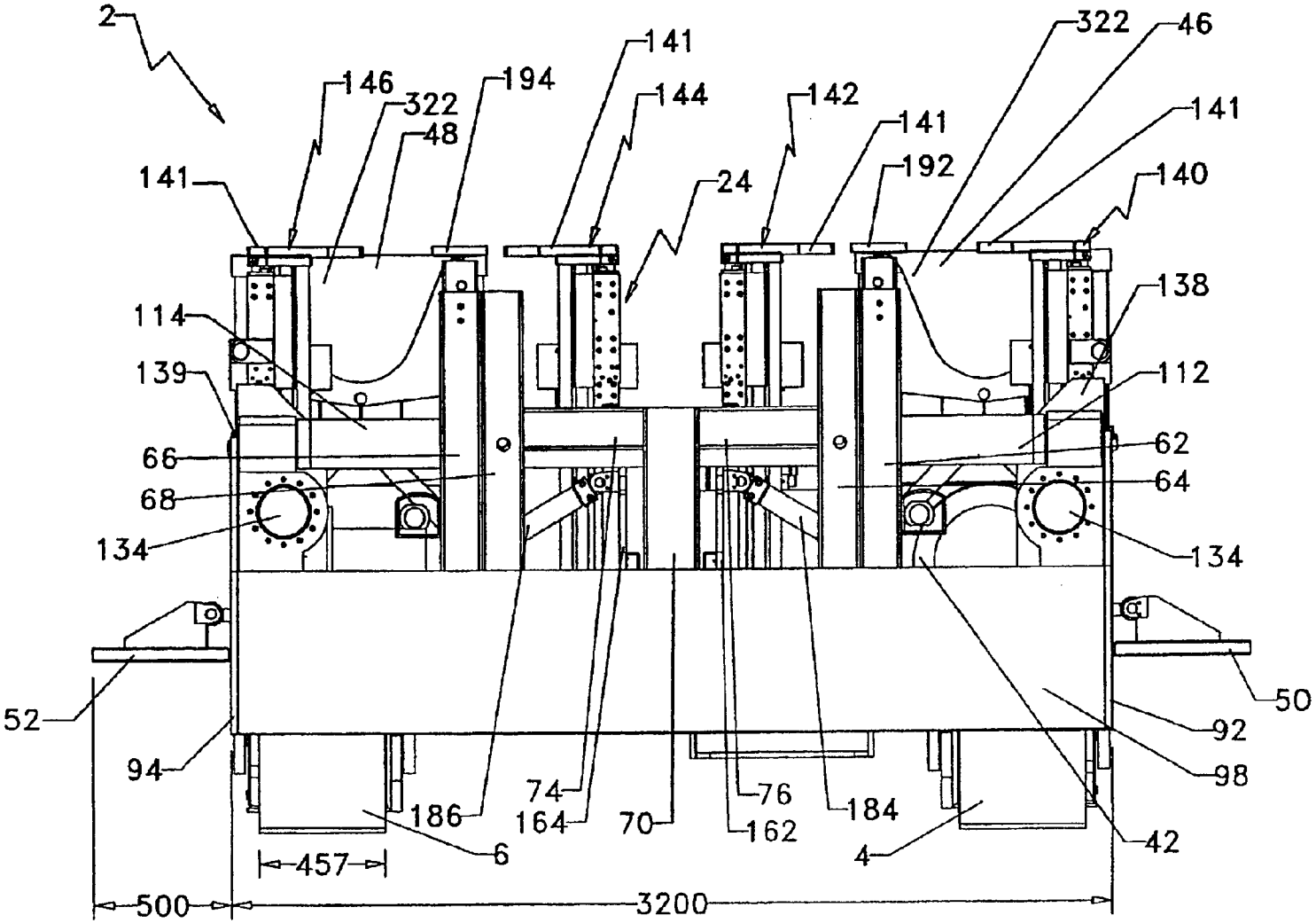
FIG. 4 illustrates a rear elevation of FIG. 1.
Figure 5:
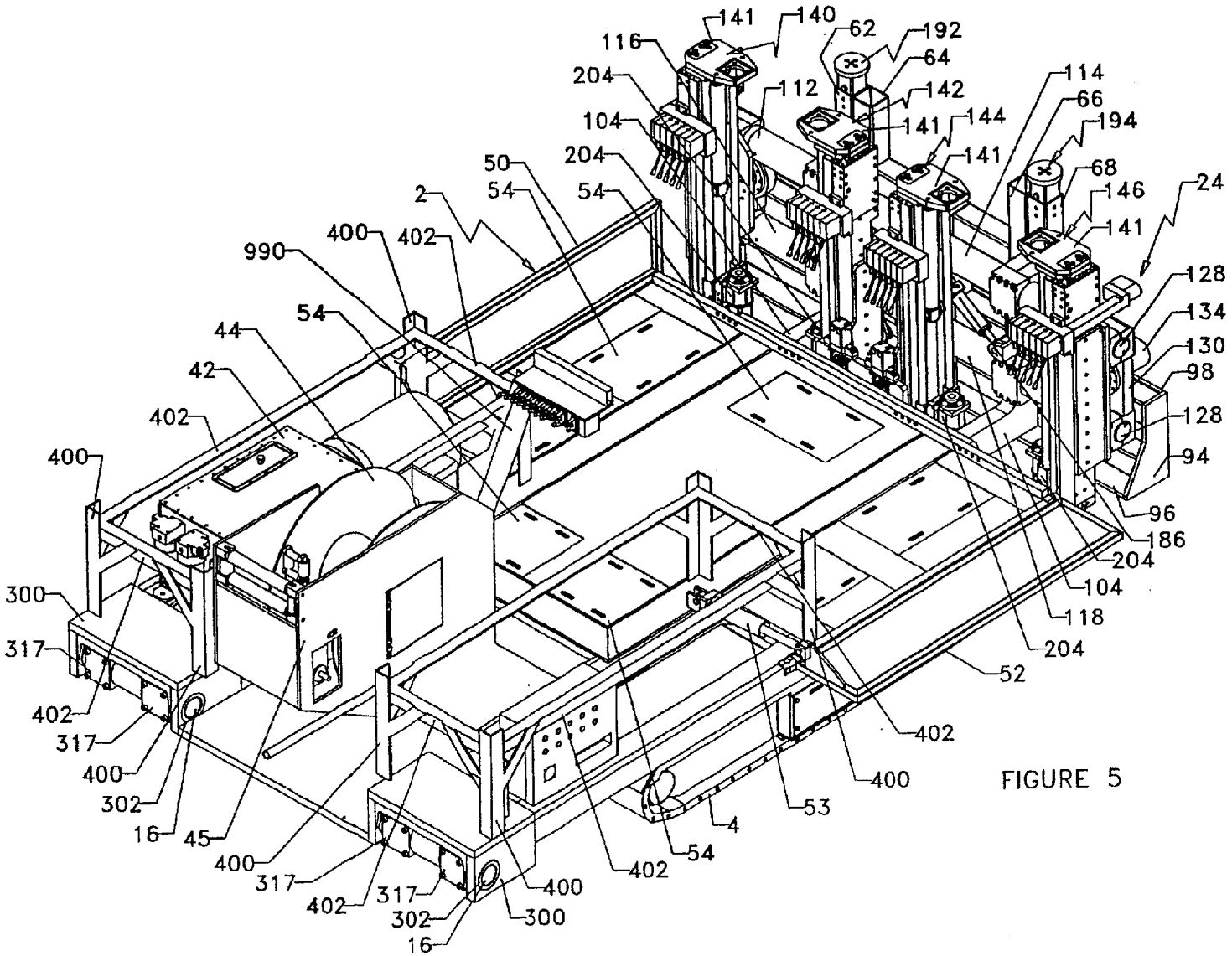
FIG. 5 illustrates a perspective view of the apparatus of FIG. 1 with material pods removed.
Figure 6:
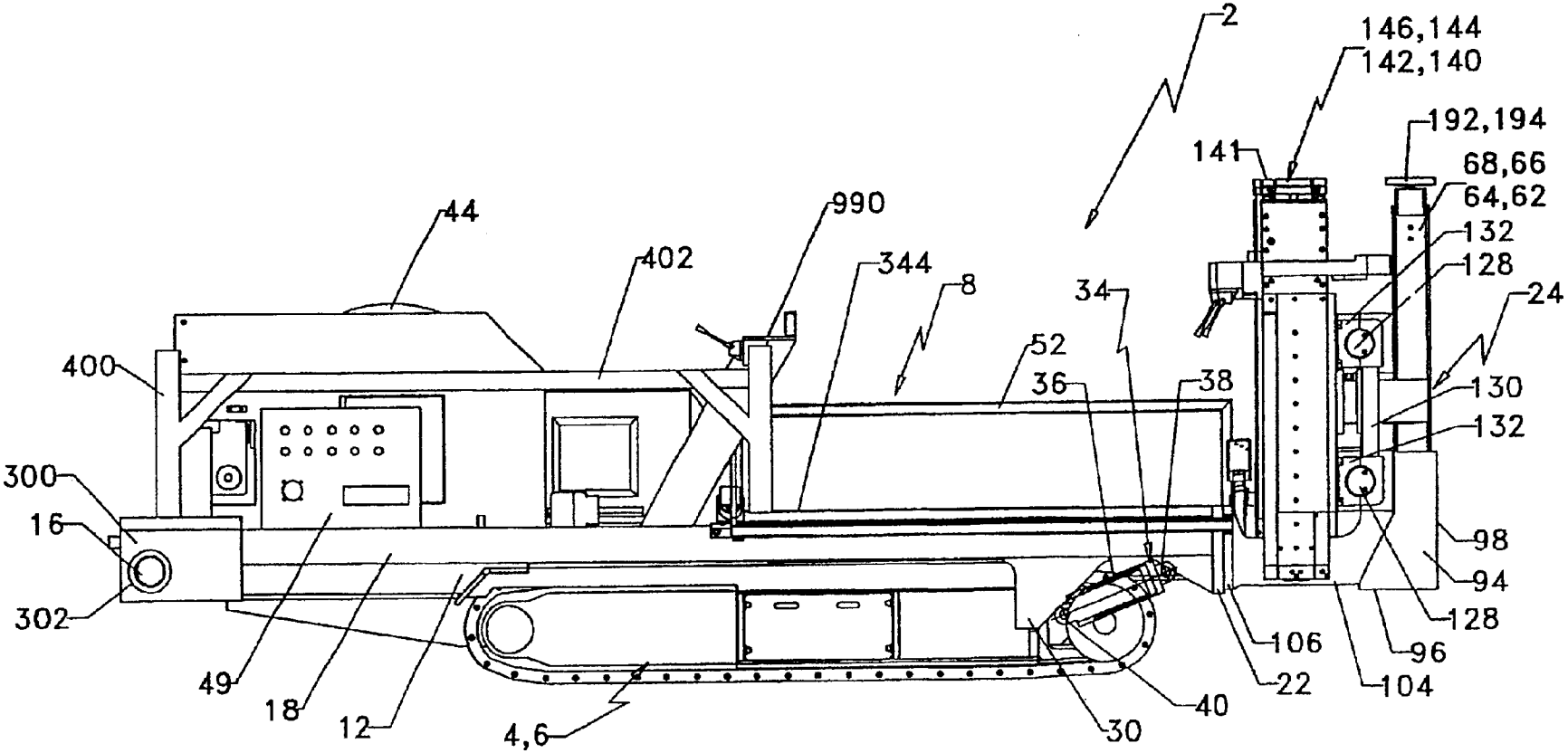
FIG. 6 illustrates a right side elevation of the apparatus of FIG. 1 with side platform rotated to vertical.
Figure 7:
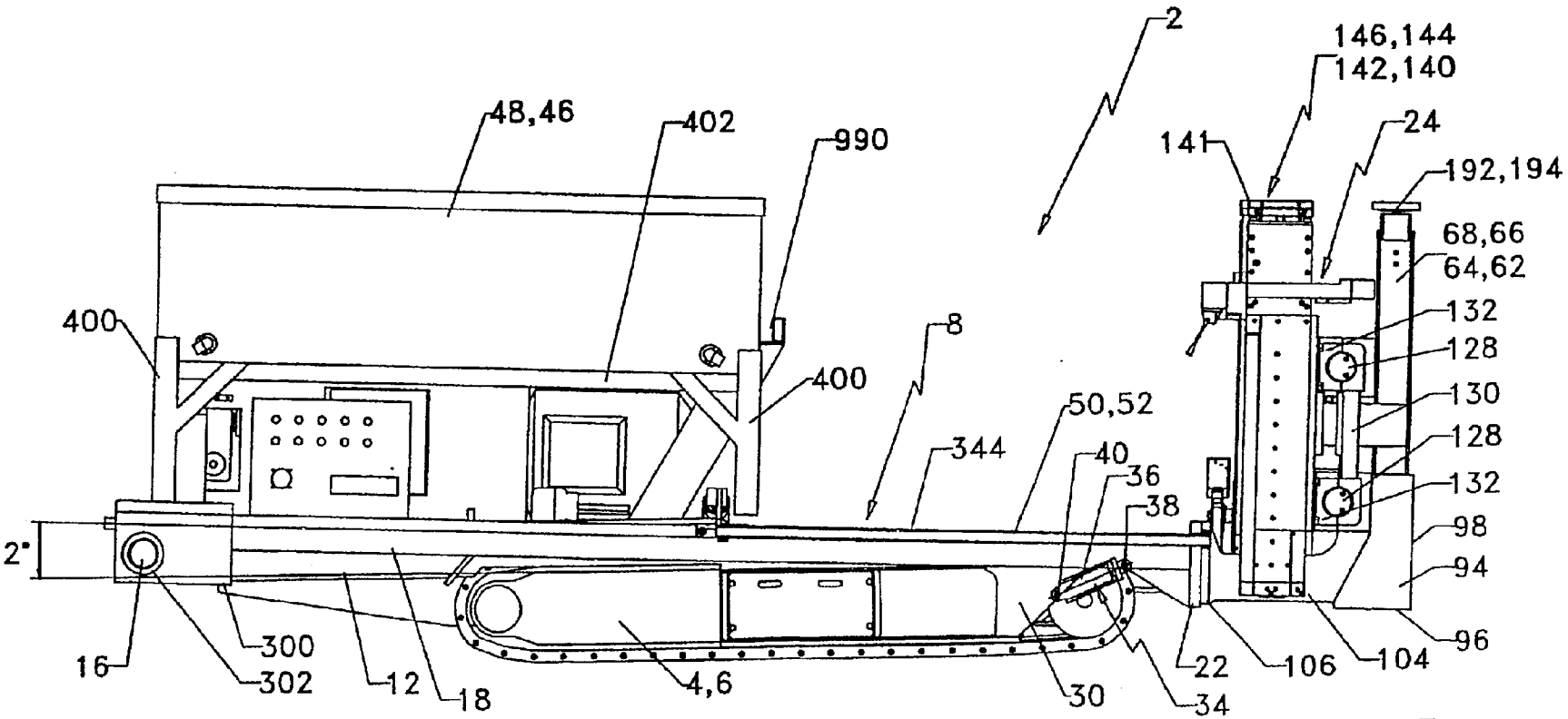
FIG. 7 illustrates right side elevation of the apparatus of FIG. 1 with the platform declined.
Figure 8:
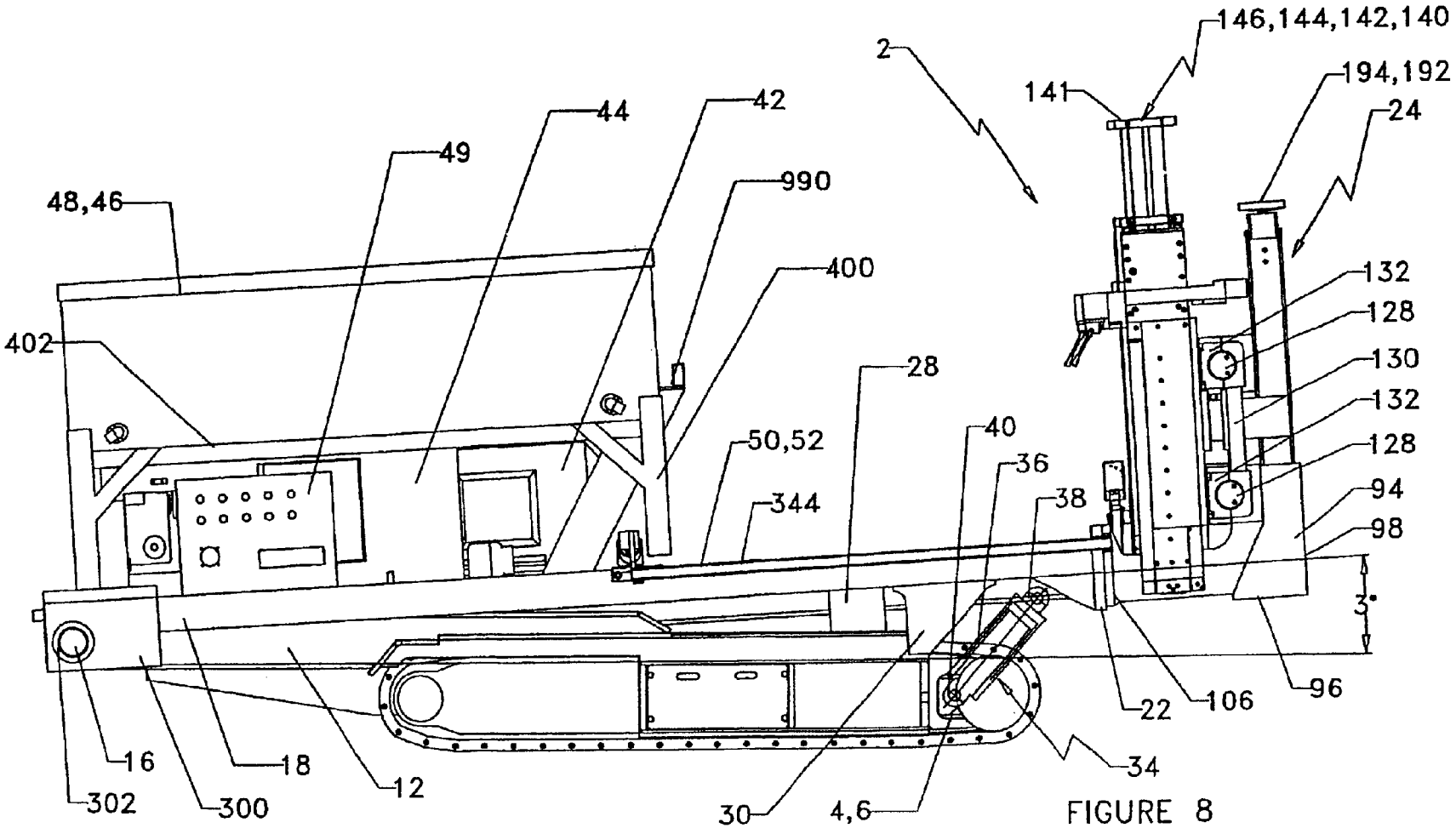
FIG. 8 illustrates right side elevation of the apparatus of Figure with the platform inclined.
Figure 9:
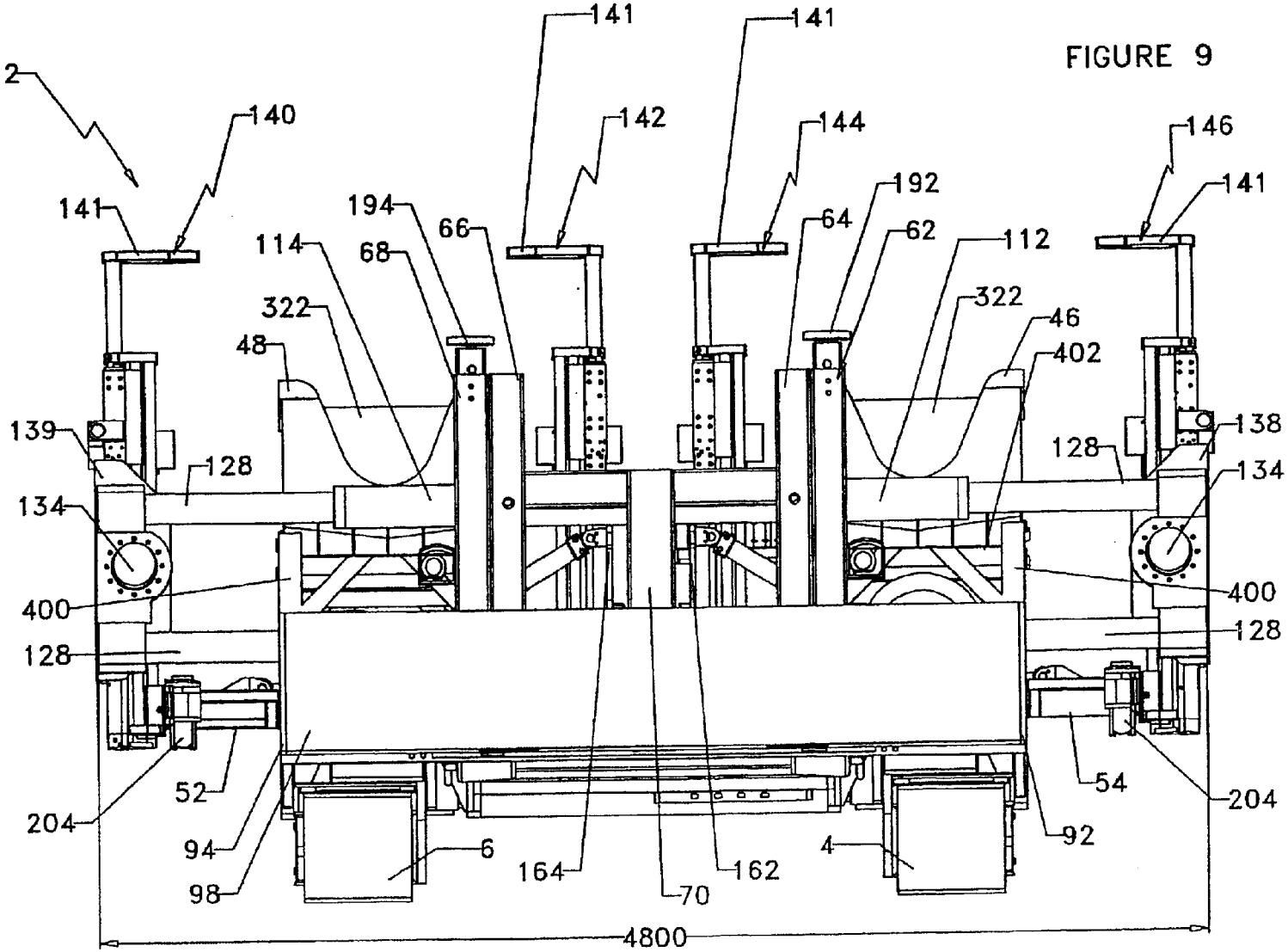
FIG. 9 illustrates a front elevation of the bolter of FIG. 8 showing the outward extension of the side mounted bolting rigs.

Illustrated in each of FIGS. 1 to 6, the bolting rigs 140, 142, 144 and 146 are all shown in a fully retracted condition and in a vertical orientation. Whereas in FIG. 7, the front of the platform assembly 8 has been lowered relative to the track units 4 and 6, so that the platform assembly 8 adopts an angle to the horizontal of approximately 2 degrees. This feature is helpful to level the bolter 2 when on an inclined roadway which is ascending in the forward direction. Whereas as illustrated in FIGS. 5, 8 and 9 the platform assembly 8 has been raised above the track units 4 and 6 to an angle of approximately 3 degrees to the horizontal. This feature is helpful for bolting purposes on declined roadways which are descending in the forward direction.

By the rotation of the platform assembly 8 relative to the track units 4 and 6 on inclined and declined roadways, the bolter 2 provides a mechanism whereby the operators can be given a level platform to work from on declines of 3 degrees or less, and on inclines of 2 degrees or less. For larger inclines and declines, the 2 and 3 degrees of adjustment helps to reduce the difficulties that would be encountered by taking 2 or 3 degrees off the incline and decline respectively. Angled platforms can be counter productive to operators, as their balance must be corrected and can change or modify such things as the angles at which they are viewing their equipment, each of which may distract the operators and thus detract from the efficiency of the operators.

The platform assembly 8 is preferably of a length which is significantly greater than the maximum lift height at the front of the platform. This feature helps to limit the amount of rotation away from the vertical that the bolting rigs go through at the front of the platform assembly 8 due to the platform assembly 8 rotating relative to the track units 4,6.

Illustrated in FIG. 9 is the front elevation of the bolter 2 of FIG. 8 and shows how side bolting rigs 140 and 146 can extend some 800 mm to the left and right sides respectively, so that roof bolting can occur, at these 4.8 m distant locations, and at any point along the 800 mm distances.

In FIG. 4 it will be noticed that fold down platforms 50 and 52 extend some 500 mm out from the side of platform assembly 8.

Figure 2:
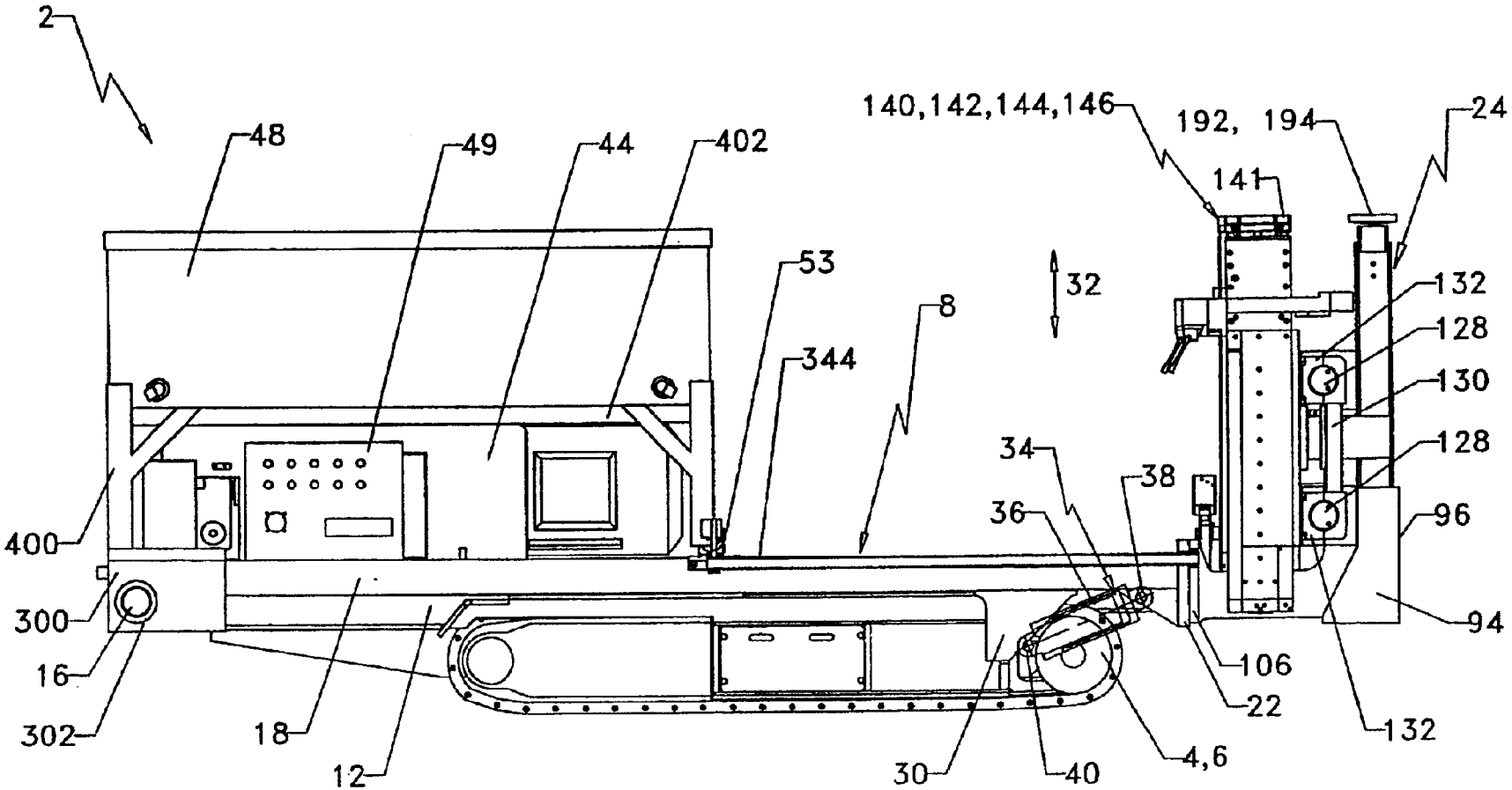
FIG. 2 illustrates a right side elevation of FIG. 1.
Figure 3:
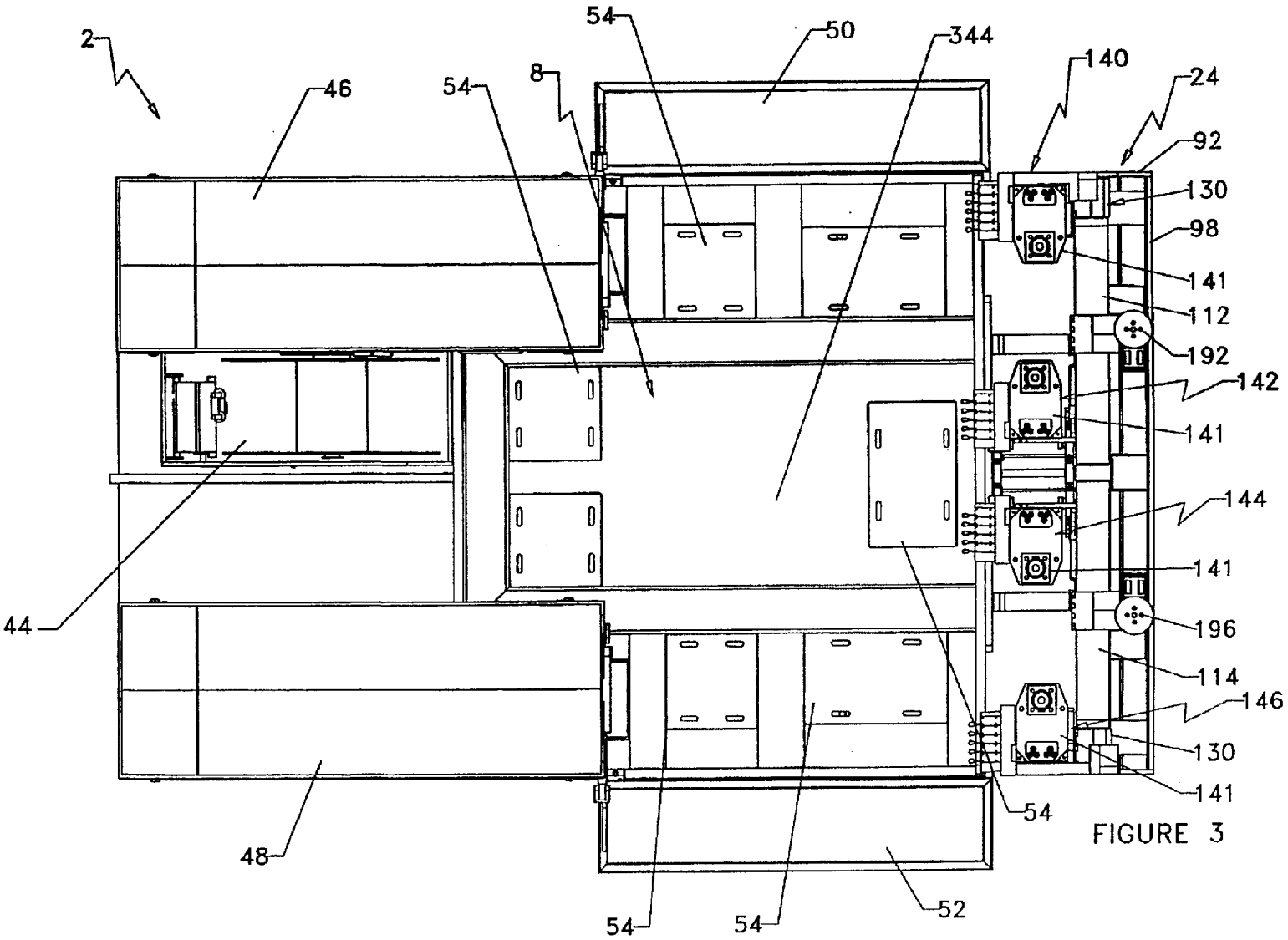
FIG. 3 illustrates a plan view of FIG. 1.
Figure 20:
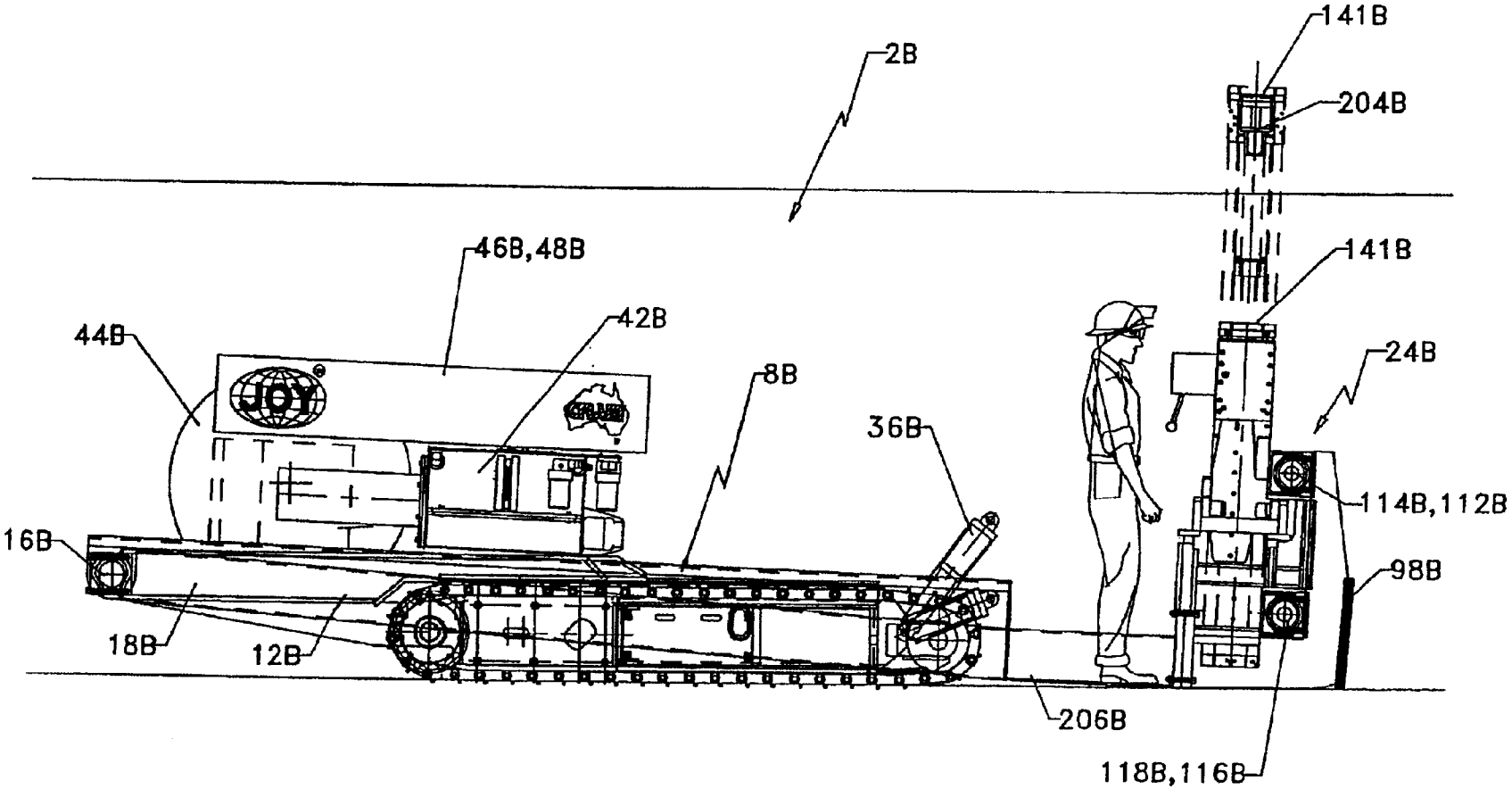
FIG. 20 illustrates a side elevation of a mobile bolting apparatus of a third embodiment.

Illustrated in FIGS. 1 and 2, and 20 track units 4 and 6 have at their respective rear ends 10, a rearwardly and upwardly extending beam 12 which is secured to the top of the structure which forms the track units 4 and 6. At the rear end of each of the beams 12 is held a cylindrical pivot bar 16. The pivot bars 16 on each track unit rotatably connect to the platform assembly 8.

Each beam 12 is a fabricated beam which terminates with a mounting block 317 attached by welding to the termini of the beam 12. The mounting blocks 317 each have a semi cylindrical formation in a rearwardly projecting face. This semi cylindrical formation receives half of the outside diameter of the pivot bar 16. The pivot bar 16 is firmly clamped into place between the mounting block 17 and mating clamping blocks which also include a semi-cylindrical formation. The mounting blocks 317 and mating clamping blocks are secured together to clamp the pivot bar 16 therebetween by means of four machine screws 312.

The platform assembly 8 is best illustrated in FIGS. 22 to 25.

The platform assembly 8 as illustrated in FIG. 22 has two yokes or devises 300 which include cylindrical bores 302 to rotatably receive respective pivot bars 16. The yokes 300 are constructed from three plate sections and are joined together by means of plate 304.

Extending forwardly of the yokes 300 are four beams 18. Each of the two inner beams 18 are secured by welding or other means to the respective edges of the plate 304.

Figure 15:
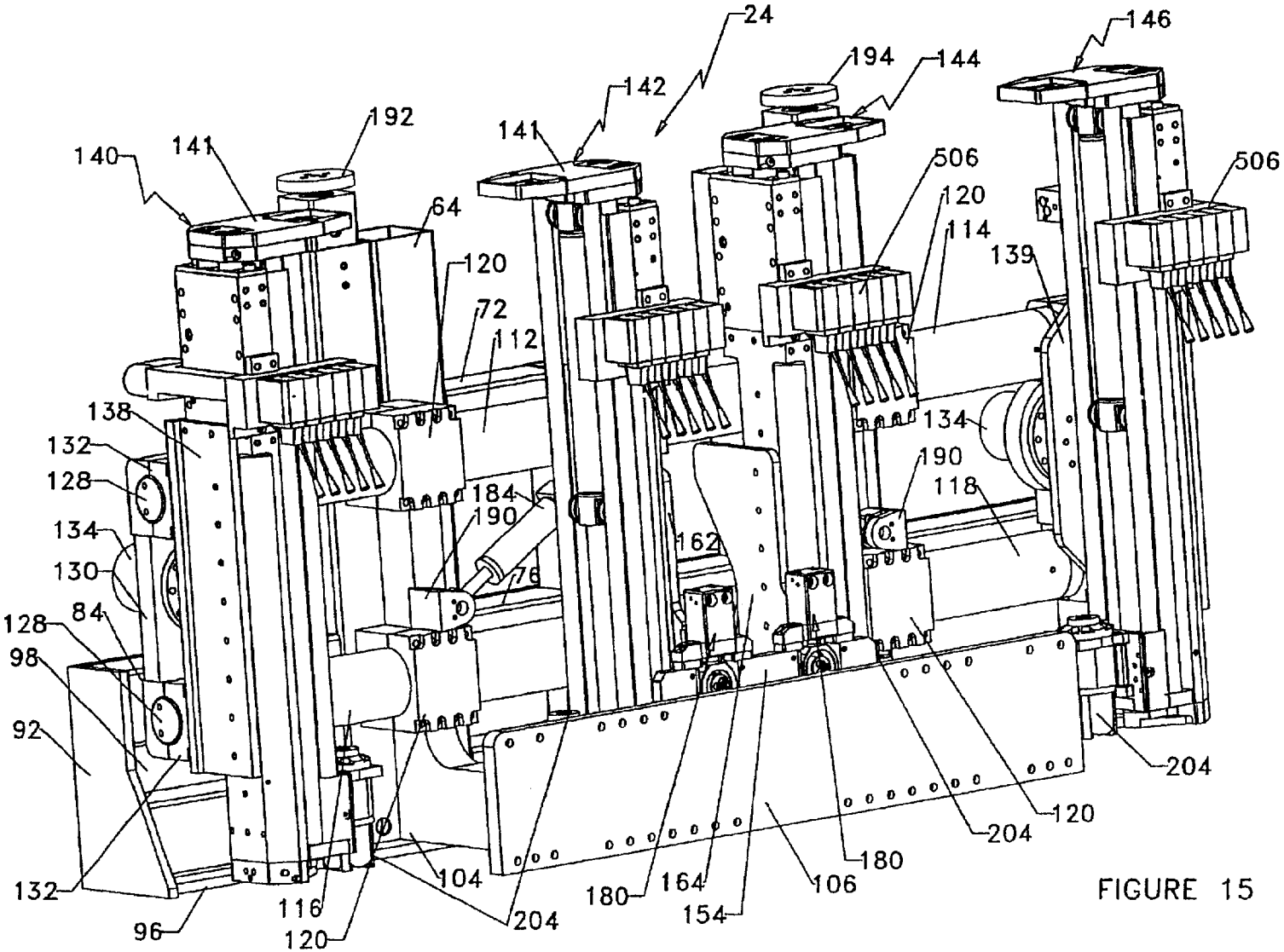
FIG. 15 illustrates a rear perspective view of an assembled bolting rig assembly.

The beams 18 extend to the forward end 20 of the platform assembly 8 and carry the rest of the platform structure. The beams 18 are attached to and terminate at their forward end with, a bridging plate 22, which extends across the full width of the platform assembly 8, to which is attached a bolting rig assembly 24, which is illustrated in FIG. 15.

Each pair of beams 18 on a side of the platform assembly 8 include an open space 306, which is of a width greater than the width of the respective beams 12 on track units 4 and 6. The space 306 allows the platform assembly 8 to be lowered at the front end as illustrated in FIG. 7, to a level whereby the beams 12 on the track units 4 and 6 protrude into the spaces 306.

Located on the platform assembly 8 are seven hatchways 54 which form part of the platform work surface when the hatches are in place. The hatches 54 can be removed or rotated to another position when it is desired to gain access to equipment and devices located under the hatches.

The platform assembly 8 once constructed can be overlayed with expanded metal mesh or other walkway surface to provide a surface with traction.

Another feature of the platform assembly 8, is the provision, as part of the platform structure, of hydraulic oil or return oil tanks 340. The oil tank 340 is relatively shallow in depth 342 but has relatively large top and bottom surfaces 344 and 346 respectively.

The provision of the tank 340 as part of the platform assembly 8 work space has several associated features.

The front end of the tank 340 is located adjacent the bridging plate 22, ensuring that the bolting rig assembly 24 need only have its return hoses cover a relatively short distance from the bolting rig assembly 24 to the return tank 340.

Another feature is that the relatively large top and bottom surfaces 344 and 346 provide the oil in the tank 340 with sufficient surface area to provide cooling of the return oil, without the need of purpose built coolers.

Towards the front end 20 of the platform assembly 8, the platform assembly 8 includes two rectangular plates 28, which are attached to the inside beam 18 of each pair of beams. The outside beams 18, of each side pair of beams, include a triangular plate 30. The respective sets of plates 28 and 30, confine the lateral movements of the forward end of the respective track units 4 and 6 to that space between the plates 28 and 30. The height of the plates 28 and 30 are of a sufficient height whereby when the platform assembly 8 is lifted off the track units 4 and 6 in the upward direction of arrows 32, to create an included angle of 3° above the horizontal, the plates 28 and 30 maintain sufficient overlap with the sides of the track units, to fulfil their confinement task.

The track units 4 and 6, provide an inside bearing plate 308 for the plates 28 to contact, while the guard member 310 can also serve a bearing function for the plates 28 to engage.

A platform assembly lifting and lowering mechanism 34 (see FIG. 1) is formed by hydraulic cylinders 36. The hydraulic cylinders 36 connect the platform assembly 8 to each of the track units 4, 6. The lifting and lowering mechanism 34 is made up of two hydraulic cylinders 36 connected at each front side of the platform assembly 8, by a respective clevis block and pin 38 welded to the inside beam 18 of each pair of beams. The other end of the respective cylinders 36 connects to a clevis block and pin 40 which is attached to the inside of each of the track units 4 and 6. Once assembled, by applying hydraulic pressure to the cylinders 36 the platform assembly 8 via the beams 18 will rotate or move relative to the track units 4 and 6 in an upward direction around the pivot 16. By removing pressure from hydraulic cylinder 36 or by applying pressure to an other side of the cylinder, the platform assembly 8 will rotate towards the track units 4 and 6.

If desired the plates 28 and 30 may be replaced by means by a very strong cylinder assembly to replace cylinders 36, or by providing multiple cylinders 36, so as to provide enough strength to prevent too much lateral movement of the track units 4 and 6 relative to the platform assembly 8.

Equipment to power the bolting rigs and track units 4 and 6, and consumables for use in the bolting processes, are carried on the platform assembly 8 at the rear thereof. The equipment is housed in two main areas. The first area is taken up by a power pack 42 which includes an electrically powered pump motor and a hydraulic power unit which is driven by the pump motor. The hydraulic power unit provides hydraulic power for hydraulic motors and actuators on the track units 4 and 6 and the drill rig assembly 24.

Positioned on the rear of the platform assembly 8, at a location inside of the power pack 42, is a cable reel 44 which is housed in its own housing 45. The reel 44 takes up and feeds out electrical cable as the bolter 2 moves into and out of a mine or changes its location. The cable provides electrical power to the pump motor and any other electrical control units or devices on the bolter 2. The cable reel 44 and its housing are preferably of a modular design so that the whole cable reel unit can be placed on or lifted off in one action.

Positioned above the power pack 42, as illustrated in the FIGS. 1 to 4 is a material pod 46 which houses a supply of consumables such as resin, bolts, and plates for the operator to use in the bolting process. The pod 46 is illustrated in greater detail in FIG. 27.

Figure 27:
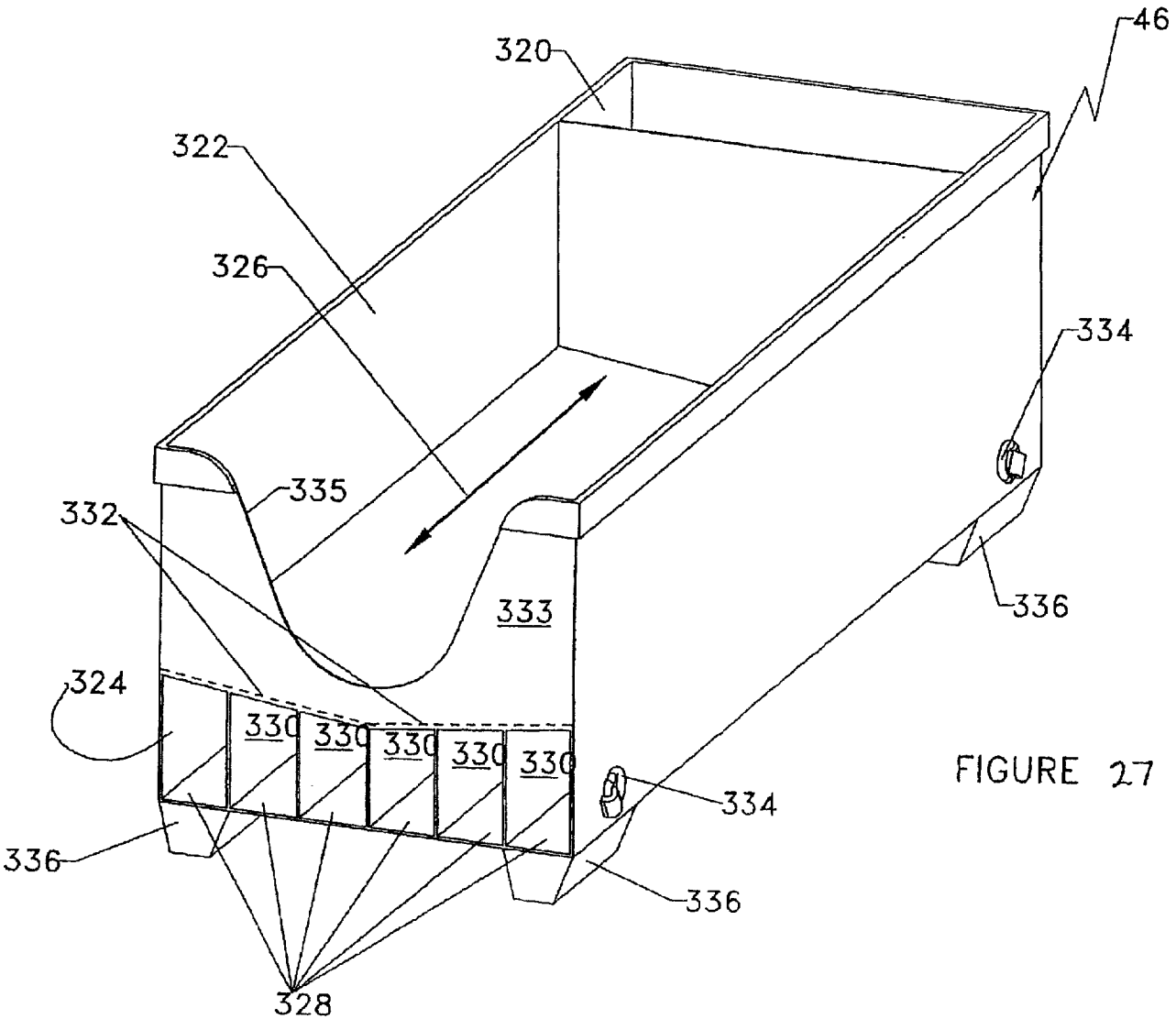
FIG. 27 illustrates a perspective view of a materials pod for use with the bolter of FIG. 1.

As illustrated in FIG. 27, the pod 46 is divided into 3 general compartment areas. The first compartment 320 occupying the rear of the pod 46, is of an open box shape and is used to store drilled plates for assembly onto the threaded ends of bolts. The compartment 320 has a depth equal to the depth of a second compartment 322.

The second compartment 322, is the largest compartment on the pod 46, to receive tendons or bolts. When the bolts are placed in compartment 322, they are oriented so that their longitudinal axis is parallel lo arrows 326. The base of compartment 322 has a converging base 332, so as to direct the bolts in the bottom of the compartment 322 towards the centre. This helps to prevent movement of the bolts once located therein. The compartment 322 is preferably of a length to receive 2.1 m length bolts. The compartment 322 is also of a depth and width to allow the compartment 322 to receive approximately 200 bolts. The front wall 333 of the second compartment 322, has a deep cut out 335, which is of a width and depth to allow an operator to gain unobstructed entry, so as to remove bolts from inside the compartments.

A third compartment 324 is of the same length as the pod 46 and is provided with as a series of six full length cavities 328. The walls 330 between each cavity 328 provide columns the length of the pod 46, to support the base 332 of the compartment 324.

The six cavities 328 receive tubes or capsules or unmixed resin for insertion into a bored hole in mine strata to set a bolt therein.

Retractable lifting lugs 334 are present on the outside of the pod 46 to facilitate lifting.

The pod 46 includes four feet 336 which have an inverted truncated pyramidal shape. Four angle iron posts 400, mounted on the platform assembly 8, receive the feet 336. The tops of the posts 400 are positioned so as to provide an opening with a length and width greater than the length and width respectively of the pod 46 (as illustrated in FIGS. 1 to 9). As the base of the feet 336 lie at the end of four converging or inwardly tapering sides, the base of the feet 336 will have a rectangular dimension some 50 mm on each side less than the rectangular dimensions of the top of the feet. By such tapered feet, an LHD (Load Haul Dump) will only need to align the pod 46 into a position within 100 mm of the sides of its final location. With this done, by lowering the pod 46, the weight of the pod 46 will centre each of the feet 336 into the posts 400 on the platform assembly 8. Once inside of the posts 40, the weight of the pod 46 is carried by the horizontal members 402 as illustrated in FIG. 5.

The pod 46 includes sufficient volumes in the compartments 320, 322 and 324 so as to carry approximately 200 bolts with nuts attached, 200 resin sausages, and 200 plates in each of the respective compartments.

When an operator has run out of bolts from pod 46, the whole pod 46 can be removed from the vehicle and replaced with a replenished pod. A second pod 48 of the same construction as pod 46 is positioned over the rear right side of the bolter 2. The pod 48 can be tot the second operator on the right side of the vehicle to access or alternatively each operator takes from one pod so that when that one pod is emptied it can be replaced with a replenished pod, while the operators take consumables from the other pod. This ensures that no break in bolting need occur during replenishment of stock of consumables on the roof bolter.

An area at the forward end of the platform assembly 8 provides a work space adjacent the bolting rig assembly 24. This area occupies approximately 2 meters measured along the length of the vehicle and across the full width of the vehicle. This area provides the operators with a floor space of full length of a bolt and allowing same to be swung into position without contacting the other operator.

The total surface area occupied by the roof bolter platform (excluding the drilling rig assembly) is a total of 14.8 square meters (platform length 4.625 meters by platform width 3.2 meters). Deducting the pod areas (under one of which the power pack 42 lies) on either side of the vehicle (at 2.2 square meters each) and the area occupied by the reel (approximately 1.26 square meters) allows a work space of approximately 9.14 square meters, including the access passage from the rear of the vehicle. Thus the percentage of work space of the total vehicle area is approximately 62%. This expansive area provides the operators with a highly useable space which allows them to operate the drill rig and bolting rig assembly 24 with a minimum of interruption to their respective tasks.

Figure 25:
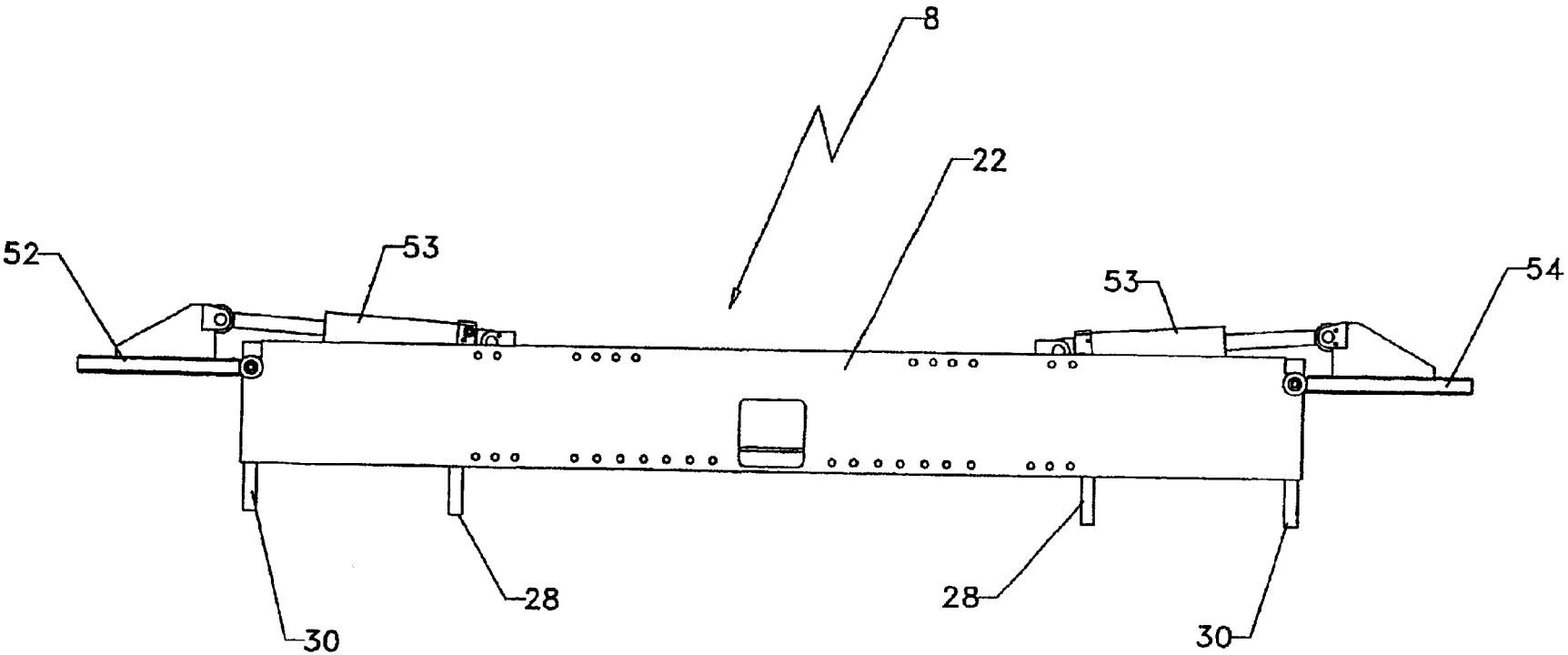
FIG. 25 illustrates a front elevation of the assembly of FIG. 16.
Figure 26:
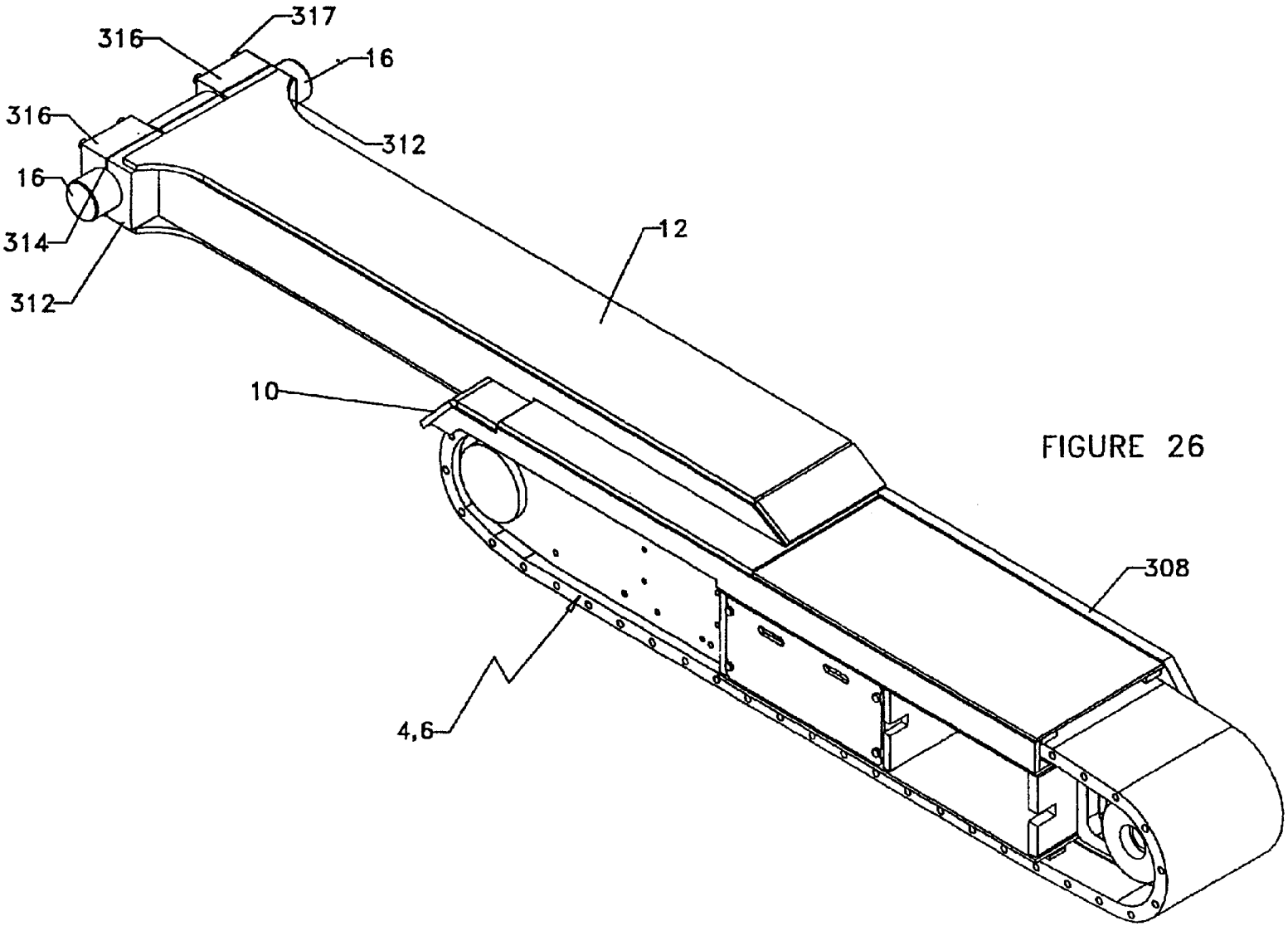
FIG. 26 illustrates a perspective view of a track unit structure with track and other components removed for illustration purposes.

Additional drop down surface area is also provided by means of two fold down platforms 50 and 52 which can be folded down so that the operator can have additional working space of approximately 500 mm wide extending back a length of approximately 2 meters with which to access the side positioned bolting rigs when they are extended. The fold down platforms 50 and 52 can be raised for tramming and lowered for working purposes as desired. The fold down platforms 50 and 52 are rotated into and out of a desired position by means of either a rotary actuator or hydraulic cylinder 53 which is illustrated in FIGS. 1, 5 and 25.

While the side bolting rigs 140 and 146 extend some 800 mm, the fold down platforms 50 and 52 are shorter. This does not effect the ability of the operator to effectively control the bolting rigs 140 and 146 as the rotational units 204 are located inboard of the 800 mm distance by some 300 mm or more. However, the fold down platforms, being some 300 mm less distance, ensures that a person who is located on the floor of the mine between the mine wall and the side of the platform assembly 8, cannot be crushed by the fold down platform 50 or 52 when either of them is being folded down.

The bolting rig assembly 24 will now be described in detail with reference to FIGS. 10 to 18, and 15.

Figure 21:
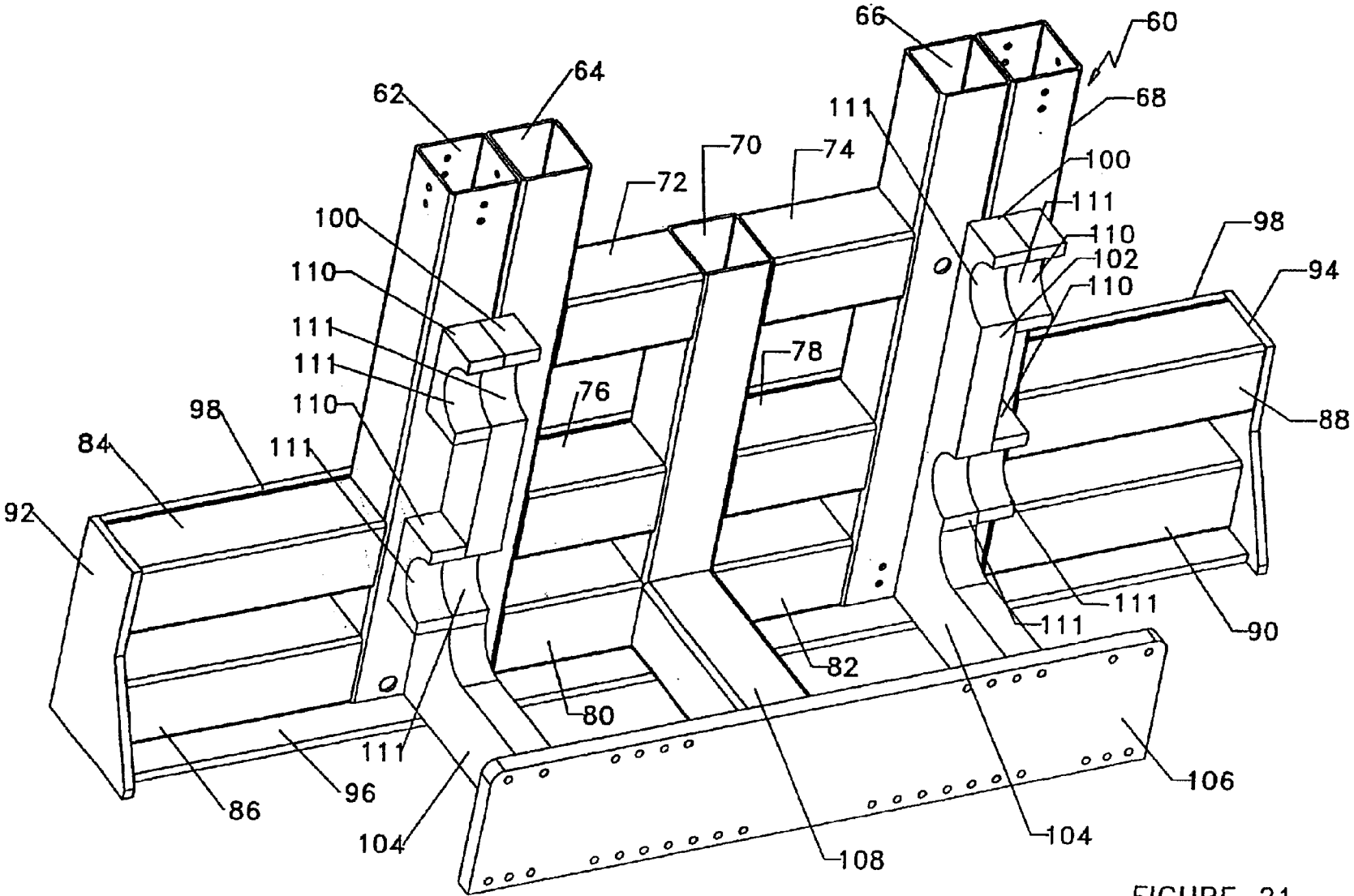
FIG. 21 illustrates a perspective view of some of the structural members of the bolting rig frame assembly.
Figure 23:
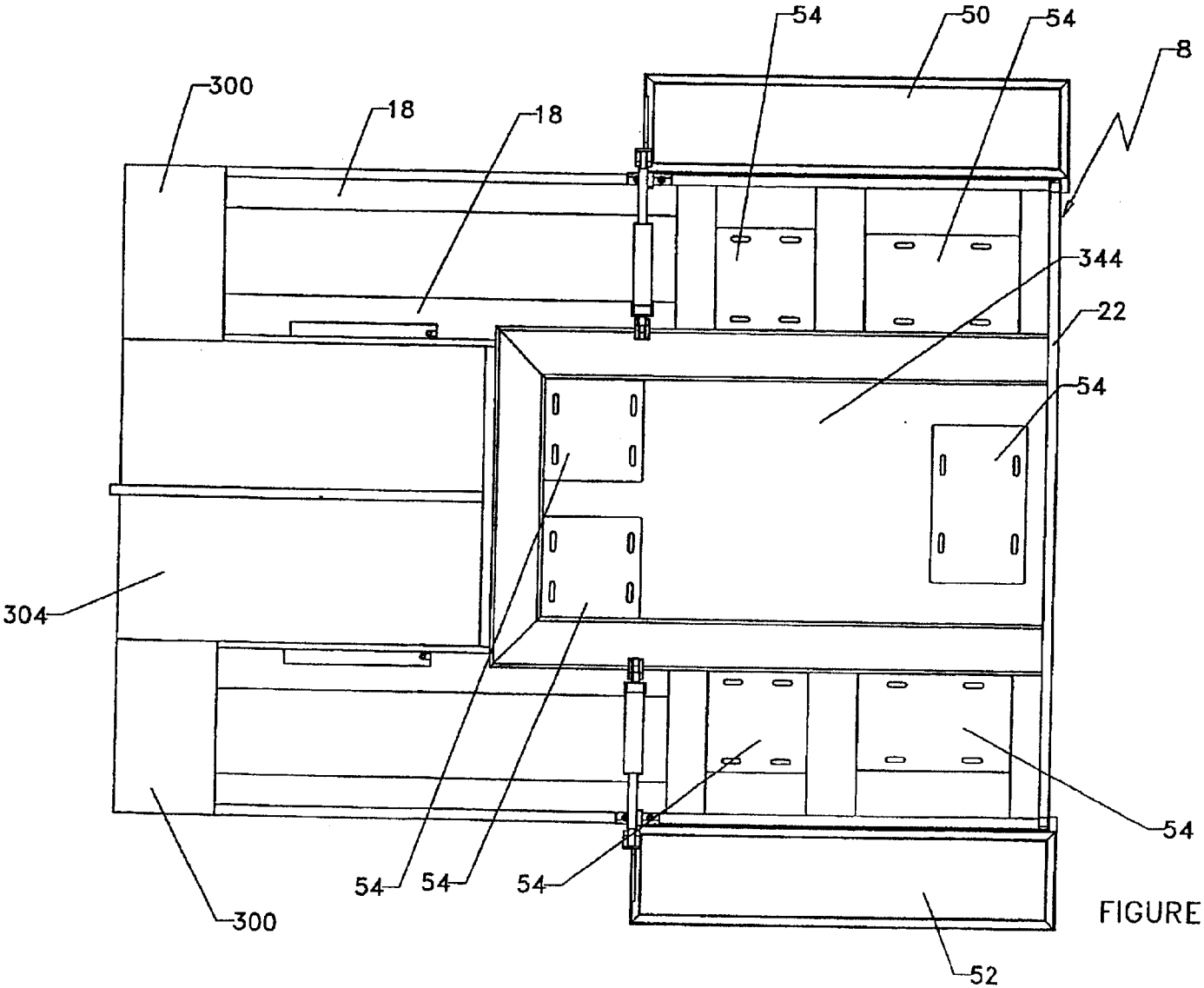
FIG. 23 illustrates a plan view of the assembly of FIG. 16.
Figure 24:
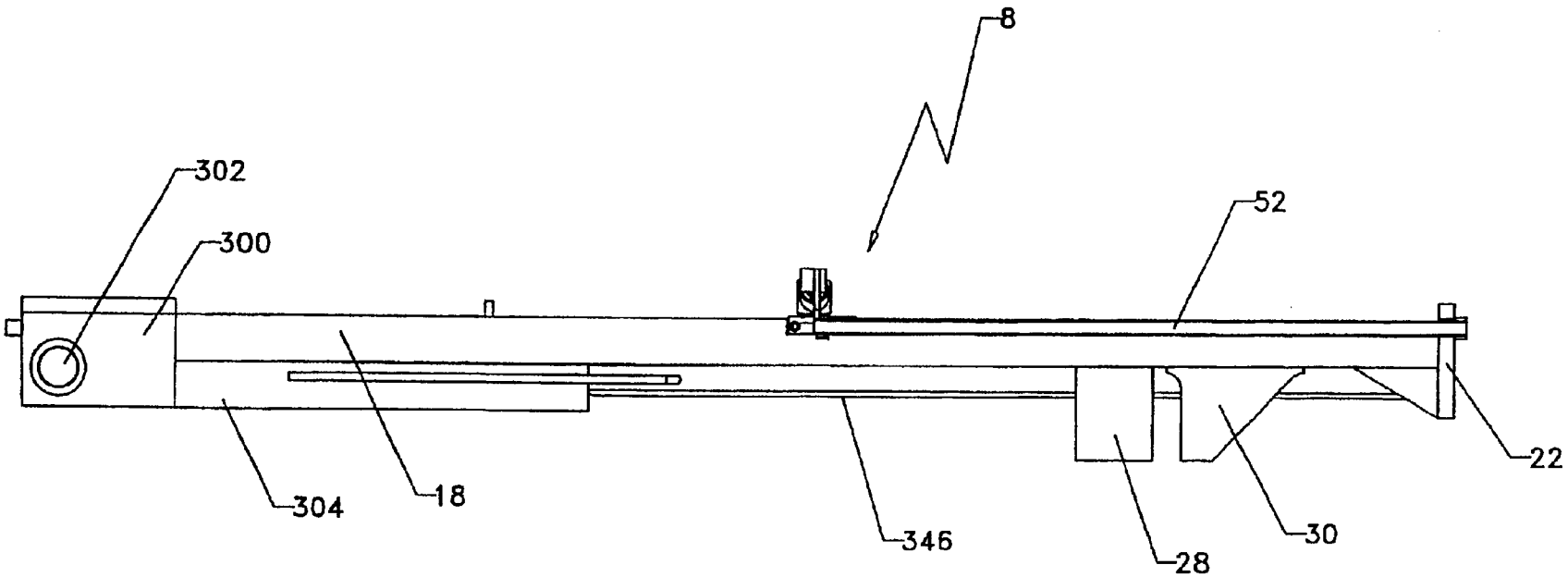
FIG. 24 illustrates a right side elevation of the assembly of FIG. 16.

Illustrated in FIG. 21 is a bolting rig frame 60 (which can also be seen fully assembled with other components in FIGS. 10 to 12 and FIGS. 15 to 17) which carries the bolting rig assembly 24 and allows same to be mounted to the platform assembly 8. The frame 60 is constructed from four central vertical posts 62, 64, 66 and 68. A fifth post 70 is located between the posts 62, 64, 66 and 68. While the posts 62, 64, 66 and 68 are of equal length, the post 70 projects to a lesser height than the posts, 64 and 66.

The posts 62 and 64, are welded or otherwise connected together as are the posts 66 and 68. The post 70 connects to post 64 on one side by means of lateral rails 72, 76 and 80 and to post 66 on the other side by means of lateral rails 74, 78, and 82. The posts 64, 70 and 66 and rails 72, 74, 76, 78, 80 and 82 are all welded together to provide a central structural unit.

Additional rails 84 and 86 are attached to the left side of the post 64 and rails 88 and 90 are attached to the right side of the post 68 so as to extend the frame 60 to the full width of the bolter 2. This allows the frame 60 to protect components mounted on the frame 60 and act as a fender or bumper bar to protect the bolter 2 while tramming.

A gusset plate 92, having a wider base dimension than its top width, is welded to the ends of the rails 84 and 86. A similarly shaped gusset plate 94 is welded to the ends of the rails 88 and 90. Along the base of the frame 60 is attached a rectangular bearing plate 96 extending from the forward surface of the rails 86, 80, 82, 90 and posts 62, 64, 66, 68 and 70 to the rearward end of the gusset plates 92 and 94. The bearing plate 96 thus extends rearward past the rearward most surfaces of the rails 86, 80, 82, 90 and posts 62, 64, 66, 68 and 70.

The front edge of the gusset plates 92 and 94 together with the front surfaces of the rails 86, 84, 76, 78, 88, 90, 82 and 80 and the corresponding front surfaces of posts 62, 64, 66 and 68 are over lain by a front plate 98. The front plate 98 will also help to protect the components located in the lower portion of the frame 60, as well as provide a more rigid frame structure.

The front plate 98 also allows the bolter 2 to be used as a grader so as to clean up a mine floor. If desired a front plate 98 having a more appropriate ground engaging shape could be utilised.

As illustrated in FIG. 21 one L-shaped member 100 straddles and is attached to each of the posts 62 and 64, with another L-shaped member 100 being attached to the posts 66 and 68. The L-shaped members 100 are attached by vertical legs 102 so as to lie between the upper level of the rails 72 and 74 and the bottom level of the lower rail, 80 and 82. A horizontal leg 104 of each L-shaped bracket 100 extends in the rearward direction of the frame 60 and terminates at a mounting plate 106. The mounting plate 106 bridges and extends past both termini of the horizontal legs 104 of the L-shaped members 100.

Connecting the mounting plate 106 to the post 70 is a longitudinally extending horizontal rail 108 which preferably has a cross section with a width equal to the width of the post 70. The rail 108 is used to support and carry other components of the frame 60 as will be described later.

Two short mounting blocks 110 are attached to the post 62 and 68 adjacent the top end of the vertical leg 102 of L-shaped member 100. The top ends of vertical legs 102 of L-shaped members 100 and mounting blocks 110 have therethrough a semi-cylindrical formation 111 to receive half of the outside diameter of cylinders 112 and 114 (see FIG. 10). Similar clamping blocks 110, having semi-cylindrical formations 111, are located adjacent semi-cylindrical formations 111 on a lower portion of the vertical leg 102. The adjacent semi-cylindrical formations create a broader bearing surface to receive cylinders 112, 114, 116 and 118. The cylinders 112, 114, 116 and 118 are relatively long, by comparison to the width of said L-shaped members 100 and mounting blocks 110.

Figure 10:
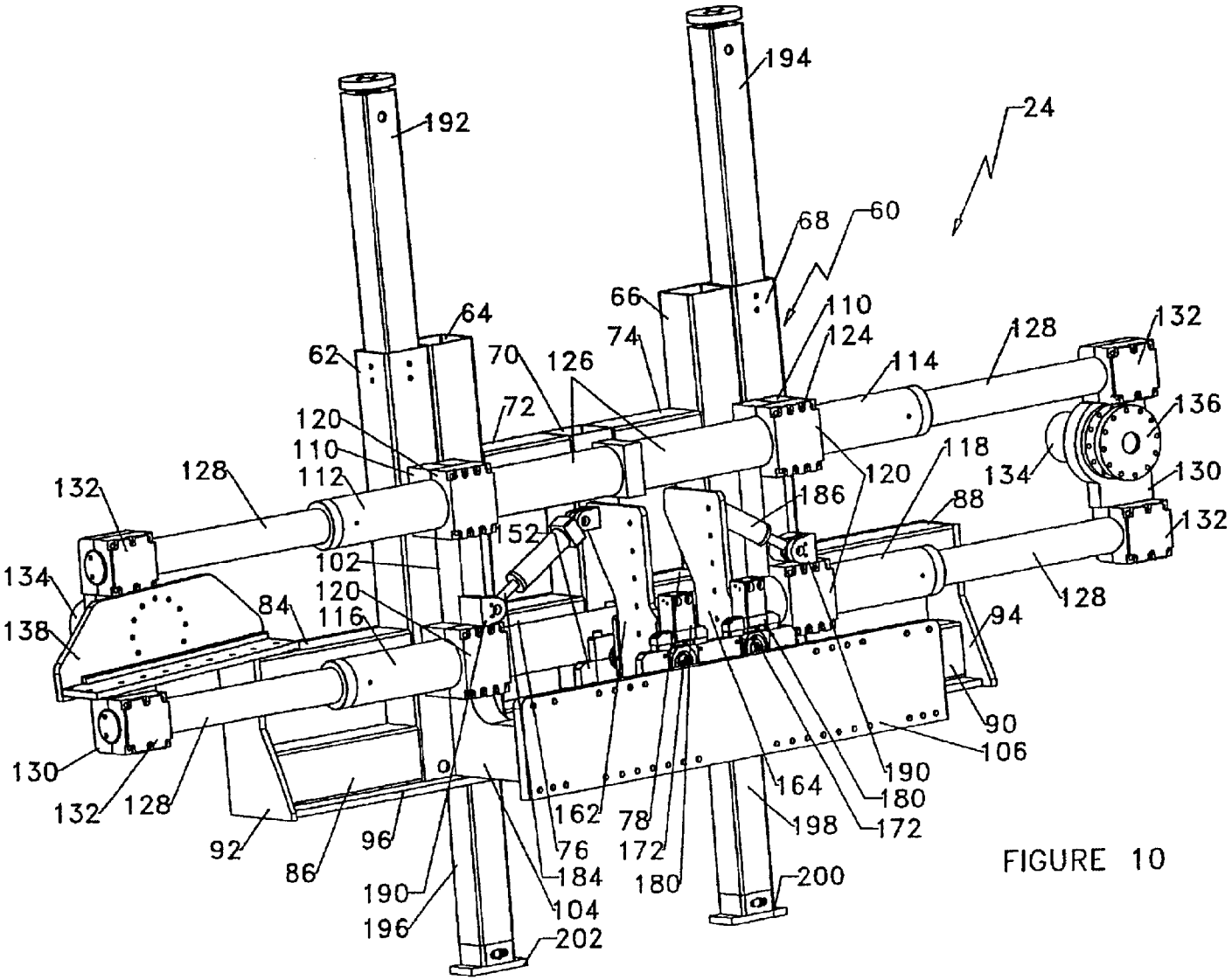
FIG. 10 illustrates a perspective view of a bolting rig frame assembly.

Referring now to FIG. 10, the cylinders 112, 114, 116, 118 are held in position by means of mating clamping blocks 120, each of which includes a semi-cylindrical formation. The clamping blocks 120 are secured to the vertical, portions 102 and clamping blocks 110 by means of eight machine screws 124 on each clamping block 120. The cylinders 112, 114, 116, 118 are held at approximately the mid point of their outer cylinders. The inward ends 126 of each outer cylinder of cylinders 112, 114, 116, 188 meet at the centre of the frame 60 and, and to reduce vibration, can be secured together.

The cylinder rods 128 which are powered to move into and out of each cylinder 112, 114, have receive on their termini a connection to a carriage plate 130, as do the cylinder rods 128 of cylinders 116 and 118. The carriage plate 130 and an associated clamping blocks 132 each include semicircular formation so that when the carriage plate 130 is assembled with clamping blocks 132, and the termini of rods 128 are there between, they clamp the termini of each cylinder rod 128. The carriage plates 130 each carry rotary actuators 134 which are limited to rotate through 180°.

Figure 11:
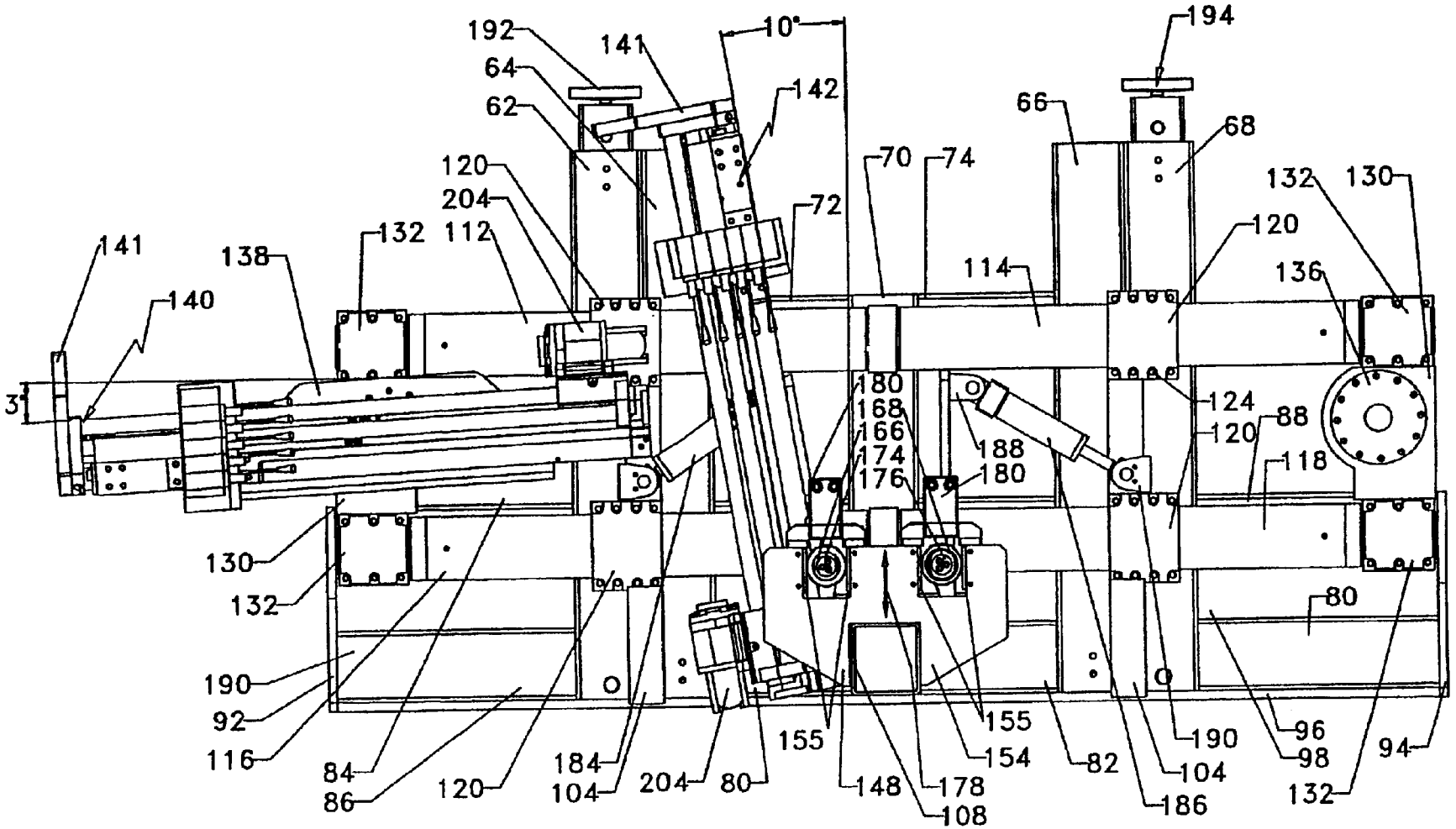
FIG. 11 illustrates a rear elevation of the apparatus of FIG. 3, with one mounting plate absent and two bolting rigs added.
Figure 12:
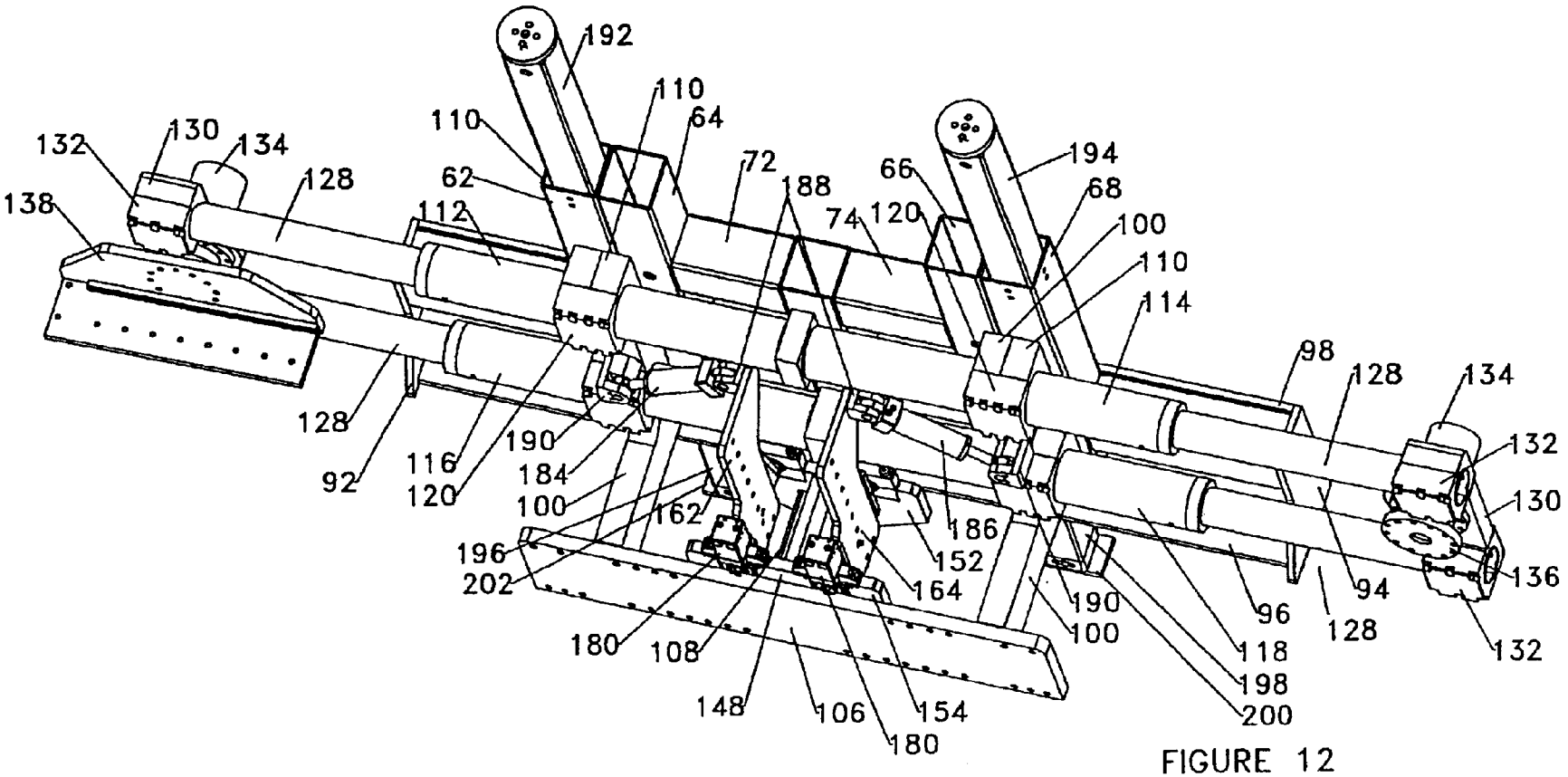
FIG. 12 illustrates an upper perspective view of the apparatus of FIG. 3.

Illustrated in the right side of FIGS. 10, 11 and 12, the frame 60 has a rotating plate 136 which is connected to the rotary actuator 134. Whereas the left side shows a mounting plate 138 to which is attached a similar plate to the plate 136, so as to be rotated by a rotary actuator 134 on that side. The mounting plate 138 receives a semi automatic bolting rig 140. The left central bolting rig 142, right central bolting rig 144 and right side bolting rig 146 are also semi-automatic. The bolting rigs 140, 142, 144 and 146 are illustrated in FIGS. 1,3,4,5,6,9,15,16, 17 and 18.

The mounting of the left centre and right centre bolting rigs 142 and 144 will now be discussed with reference to FIGS. 11–15.

Figure 14:
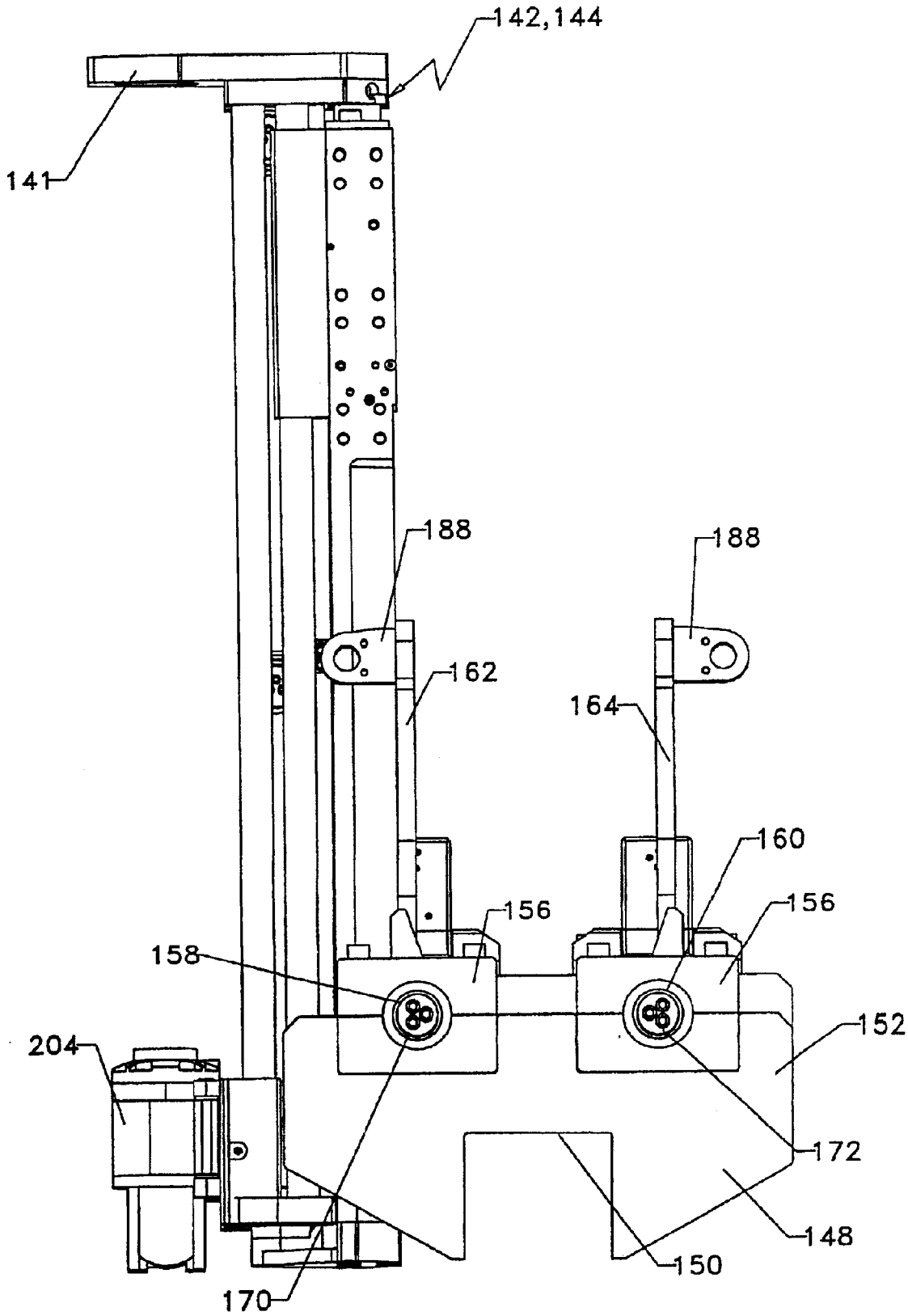
FIG. 14 illustrates a front elevation of the apparatus of FIG. 3.

Illustrated in FIGS. 11 to, 15 is a carrier 148. In FIG. 14 is illustrated the front end of the carrier 148. Whereas in FIG. 11 is illustrated the rear end of the carrier 148. The carrier 148 has a front plate 152 and a rear plate 154 with a square cut out portion 150 in each plate, which allows the carrier 148 to be located upon the horizontal rail 108 in the centre of the frame 60.

The front plate 152 which is illustrated in FIG. 14, includes two bearing blocks 156 which respectively clamp into position spherical bearings 158 and 160. The spherical bearings 158 and 160 receive forward end stub axles 170 and 172 which are respectively attached to elongated indexing plates 162 and 164 which in turn receive and secure the bolting rigs 142 and 144.

The indexing plates 162 and 164 include on their rearward ends respective stub axles 174 and 176 which carry spherical bearings 166 and 168. The spherical bearings 166, 168 and axles 174 and 176, on the rear ends of the indexing plates 162 and 164, are mounted onto the rear plate 154 so as to be able to slide in the direction of arrows 178. This is done by connecting the bearings 166, 168 via respective housings 182 to respective cylinders 180. Plate 154 has a slot 155 that has bearing plates on each vertical side, so as to guide and laterally restrain the housings 182 in their movement in the direction of arrows 178. The cylinders 180 are in turn mounted on the top edge of the rear plate 154.

Figure 13:
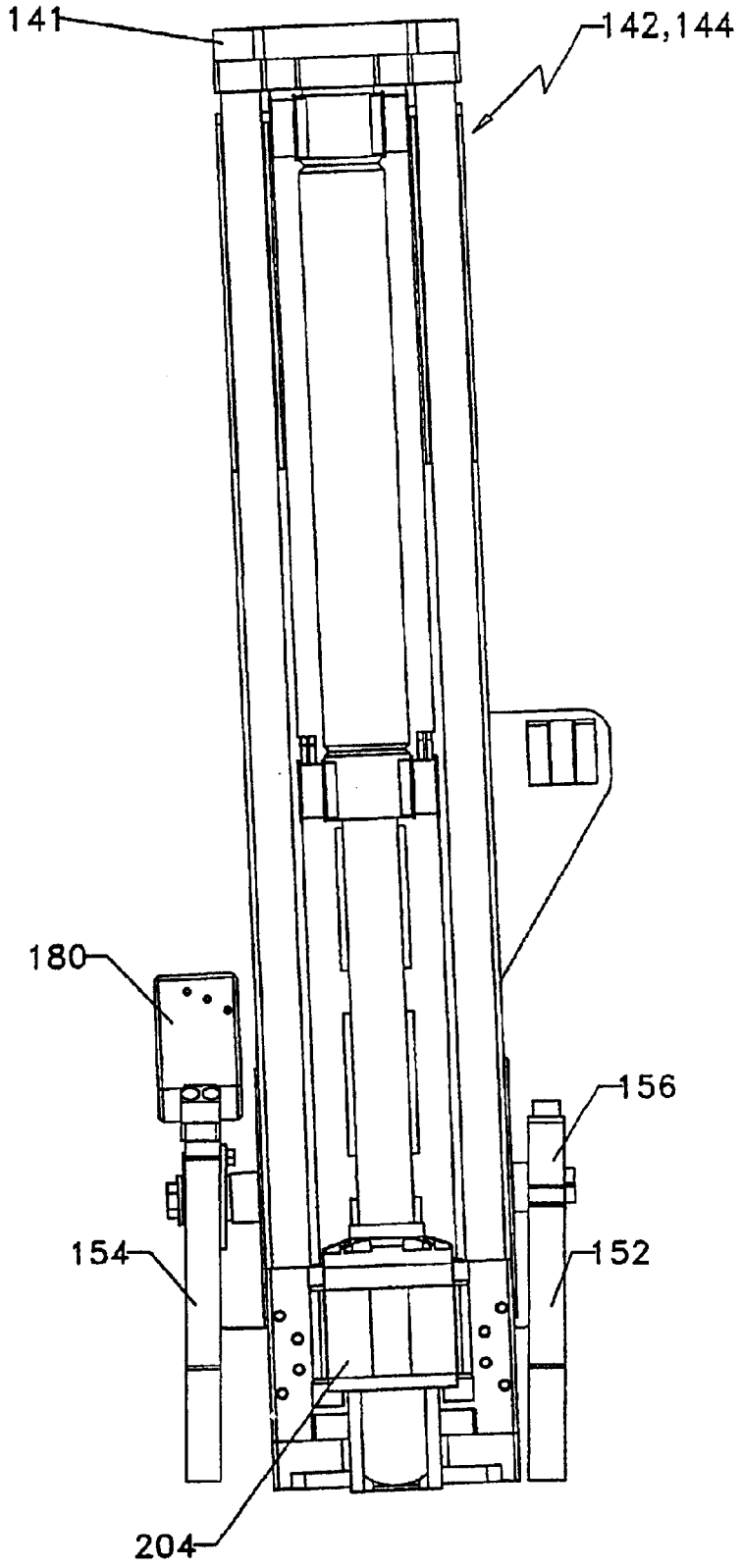
FIG. 13 illustrates a side elevation of a central bolting rig mounted on an indexing assembly.

Upon actuation of the cylinder 180, the housing 182 moves either upward or downward in the slots 155, as desired, thus adjusting the angle of the bolting rig 142 or 144 mounted to the indexing plates 162 and 164 respectively as is illustrated in FIG. 13

Referring now to FIG. 11, the movement created by the cylinders 180 will produce a rotation or a tilting of the bolting rig 142 (or 144) into and out of the page. The amount of movement achieved by cylinders 180 is approximately +/−2° from the vertical.

The forward and rear stub axles 172, 174 on the indexing plate 162 have their central longitudinal axes collinear as are the axles 170, 176 on the indexing plate 164.

The indexing plates 162 and 164, by means of the respective axles 170, 172, 174, 176, are able to rotate around the central longitudinal axes of those axles. Such rotation is produced by means of respective cylinders 184 and 186 which are secured by clevis and pin 188 to the indexing plates 162 and 164 and at their other end to the frame 60 via clevis and pin 190 which are attached to the vertical legs 102 of L-shaped members 100. In the clevis and pin 188 and 190 spherical bearings are provided to engage the eyes of the cylinders 184 and 186 to allow for the +/−2° mis-alignment which results when the cylinder 180 is activated to move the indexing plate 162 or 164 away from the vertical.

As illustrated in FIG. 15, bolting rigs 142, 144, 140 and 146 are respectively secured to each of the indexing plates 162, 164 and mounting plate 138 on the left hand side and 139 on the right hand side of the frame 60. Each bolting rig 142, 144, 140 and 146 is identical, thus helping to reduce inventory of parts. The bolting rigs 140, 142, 144 and 146 are illustrated in FIG. 15 in fully retracted and tramming position and are located in a vertical direction and substantially within the width of the outside surfaces of each of the gusset plates 92 and 94.

The posts 62 and 68 each carry upwardly directing stab jacks 192 and 194. Whereas the posts 64 and 66 each carry downwardly directing stab jacks 196 and 198. The stab jacks 196 and 198 include, at their termini, feet 200 and 202. When the stab jacks 196 and 198 are fully retracted, their feet 200 and 202 are also fully retracted into and sit flush with the bearing plate 96, as illustrated in FIG. 17. By this means, the feet 200 and 202 are also protected by the bearing plate 96 during tramming or other activity, when the stab jacks 196 and 198 are fully retracted.

It will be noted from FIG. 15 that each of the drill rigs 140, 142, 144 and 146 are positioned in pairs (one pair on the left made up of drill rigs 140 and 142, a second pair on the right). The rotational units 204, of for example the left pair, face each other so that there is an unoccupied space between them. This allows the operator of the left pair unobstructed access to the two rotational units 204 which are under his control. The right pair has the same feature.

Figure 16:
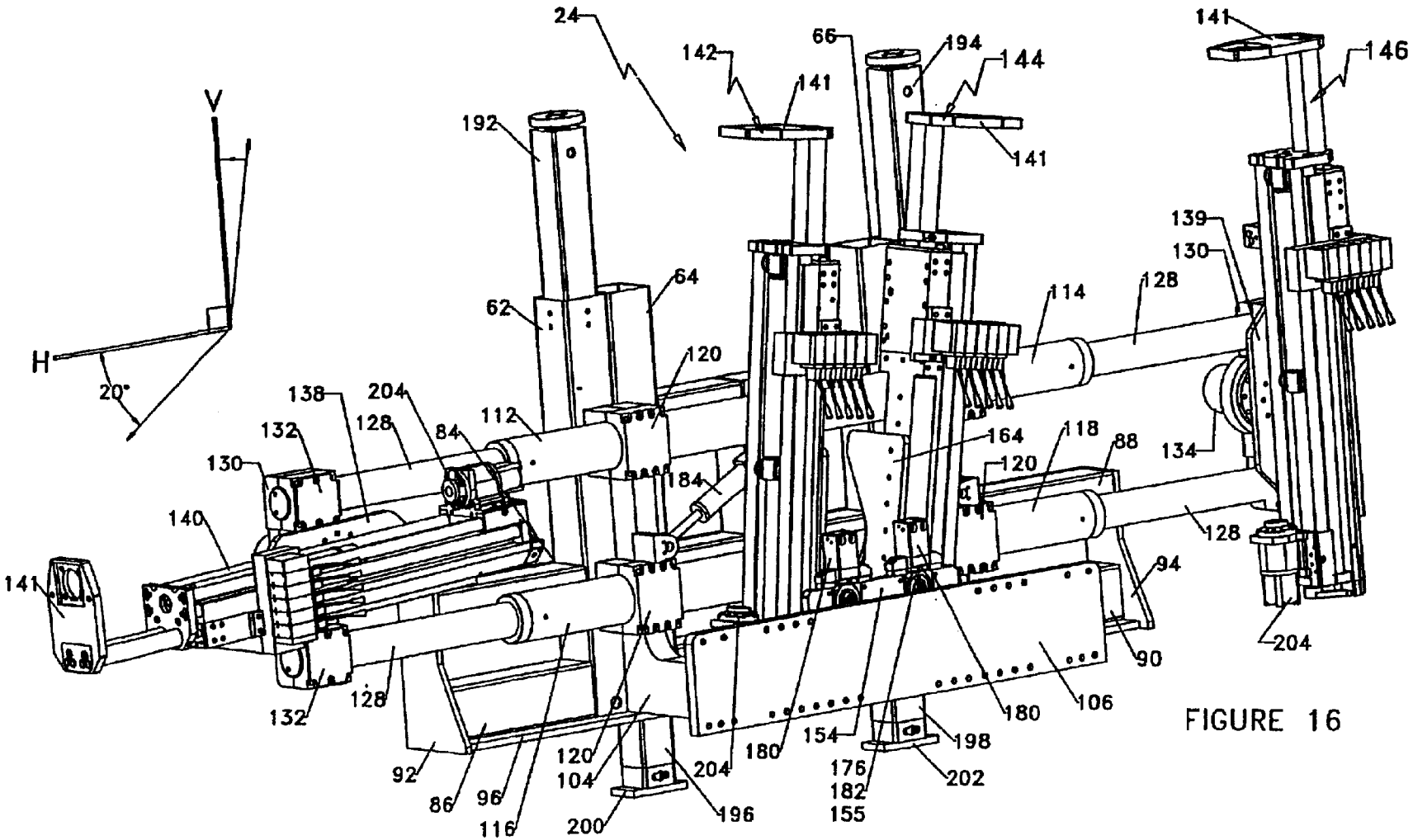
FIG. 16 illustrates the same view of the apparatus of FIG. 8, with each bolting rig deployed.

As illustrated in FIG. 16, with the cylinder rods 128 extended as on the right hand side of the figure, the bolting rig 146 can adopt a vertical orientation so as to do roof bolting. Whereas, as can be seen on the left hand side, the left side bolting rig 140 is rotated to approximately 90° so as to allow the bolting rig 140 to perform rib bolting functions. The rotary actuators 134 are each controlled to deliver a desired amount of rotation of the rigs 140 and 146 depending upon what type of bolting is required.

The two central rigs 142 and 144 can have imparted to them degrees of tilt provided by the indexing plates 162 and 164 and/or the mounting of the bearings by means of cylinder 180. The limits of side to side tilt of the indexing plates 162 and 164 and thus rigs 142 and 144 is 10° in the outboard direction, and 7.5° inboard. Whereas inbye (rearward) and outbye (forward) tilting movement as discussed above is +/−2°.

Figure 18:
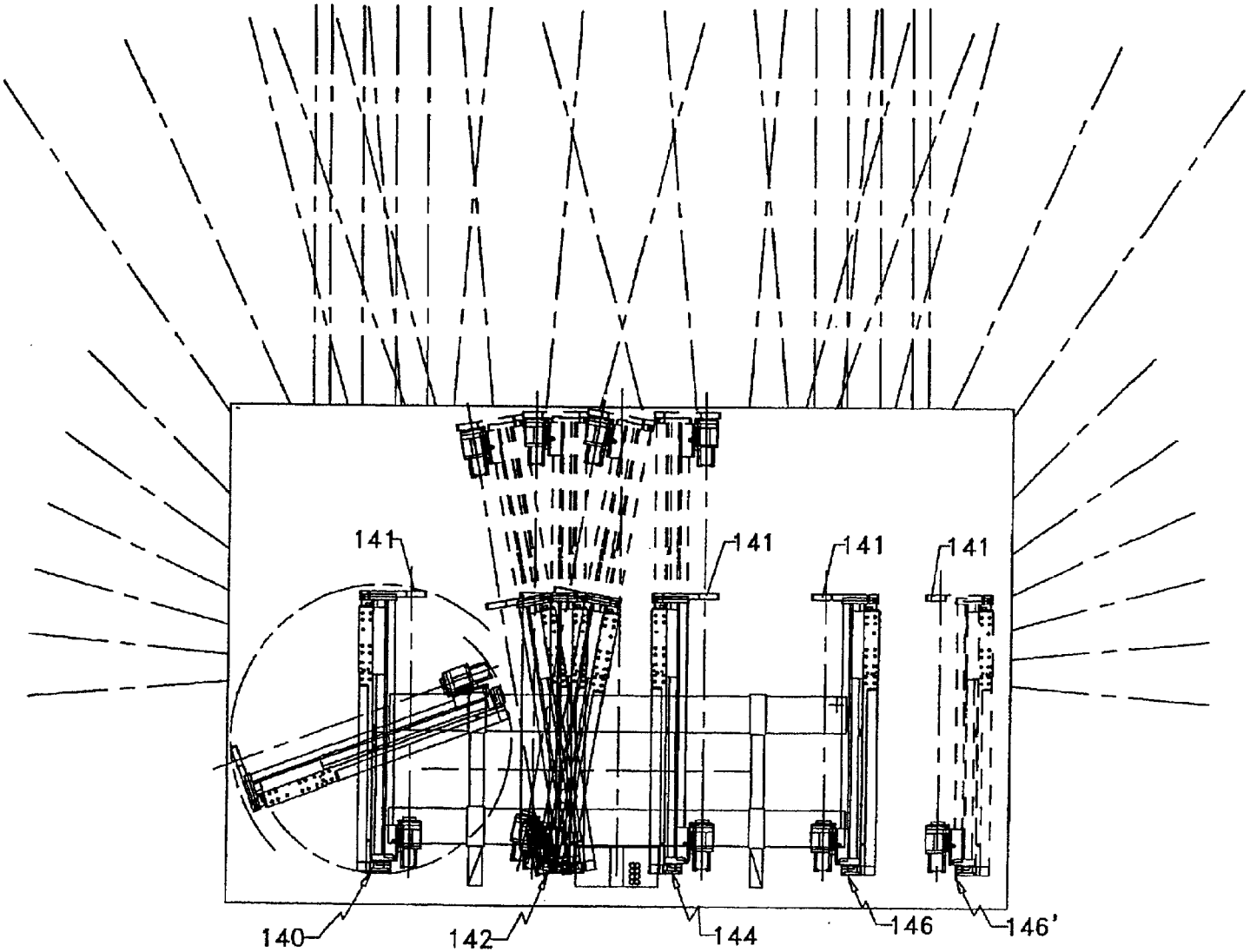
FIG. 18 illustrates in schematic the range of movements of the bolting rigs.

The ranges and the limits of movement which can be given to the rigs 140 and 146, are as illustrated by the vectors in FIG. 18. The limits when measured from a vertically standing position with the cylinder rods 128 fully retracted, is approximately 700–800 mm outward from the frame 60 (this distance is indicated in FIG. 18 by the bolting rig 146' which represents the location of the bolting rig 146 when fully extended away from the frame 60) and approximately 120° of rotation starting at approximately 10° from vertical continuing through 90° from vertical to horizontal and through to 20° below horizontal and indexing at all angles there between.

This amount of rotation could be increased through to a full 360° when the cylinder rods 128 are at their full extension. However, 120° of rotation is only permitted to the rigs 140 and 146 so as to perform a full range of roof and rib bolting functions, when cylinder rods 128 are fully retracted. The amount of rotation available when the cylinder rods 128 are fully retracted is limited by the risk of collision of a portion of the rigs 140 or 146 with the other rigs 142 or 144 respectively or with the components of the frame 60. As only 120° is permitted, a rotary actuator that rotates through 360° is not required. A 180° rotary actuator will suffice, with stops being provided at appropriate limits of rotation.

Illustrated in FIG. 18 is a schematic of the range of vectors, when the bolter 2 is viewed in front or rear elevation, which are able to be drilled along to install roof or rib bolting.

Figure 19:
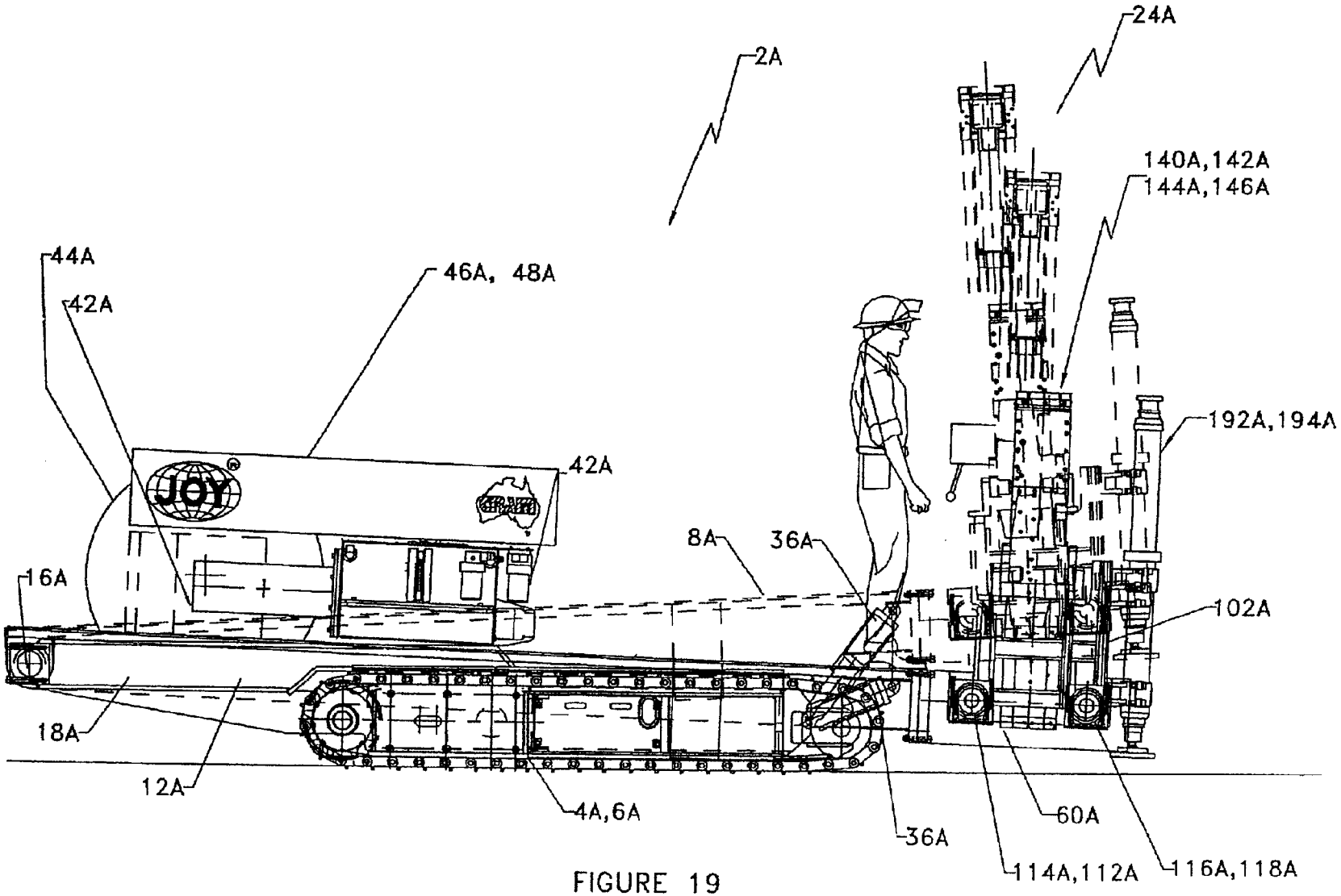
FIG. 19 illustrates a side elevation of a mobile bolting apparatus of a second embodiment.

Illustrated in FIG. 19 is a second embodiment of the invention. Features in FIG. 19 which are alike with features is in FIGS. 1 to 9 have been numbered with the same numeral followed by the letter "A". The bolter 2A has an alternatively formed bolting rig assembly 24A. The assembly 24A includes roof supports 192A and 194A in a stand alone arrangement at its forward most end. The assembly 24A also includes a series of four roof bolters mounted on a frame attached to platform assembly 8A.

The bolting rig assembly 24A has a right angled or L shaped frame 60A which mounts the cylinders 114A and 118A on the right side of the frame 60A, not in a vertical plane as in frame 60 of the previous figures, but in a horizontal plane. The cylinders 112A and 116A are mounted similarly on the left side of frame 60A. The vertical side 102A of the frame 60A includes a rotary actuator to which the left and right side bolting rigs 140A and 146A can be mounted, so as to rotate for rib bolting.

Illustrated in FIG. 20 is a bolter 2B for low height applications which has a bolting rig assembly 24B which is similar to the bolter 2A that of FIG. 19. Features in FIG. 20 which are alike with features in FIGS. 1 to 9 have been numbered with the same numeral followed by the letter "B". For low height applications, the platform assembly 8B provides a lower most level 206 on the outboard sides of the outer beams 18B, in which can be positioned a seat. The lower most level 206 can be positioned to rest on a mine floor. Seating an operator in contact with the mine floor for low height applications will result in less risk of injury being able occur to the operator yet maintain full accessibility to drill rods which are placed on the platform nearest to the operator and rotational units 204B. At the very front of the bolting rig assembly 24B there is preferably located a plate or blade similar to the front plate 98B which in low height applications will allow the bolter 2B, to grade a lower level into the floor of a mine, which will allow the tops of the bolting rigs to progress forward into a mine if insufficient room is not immediately available.

Figure 28:
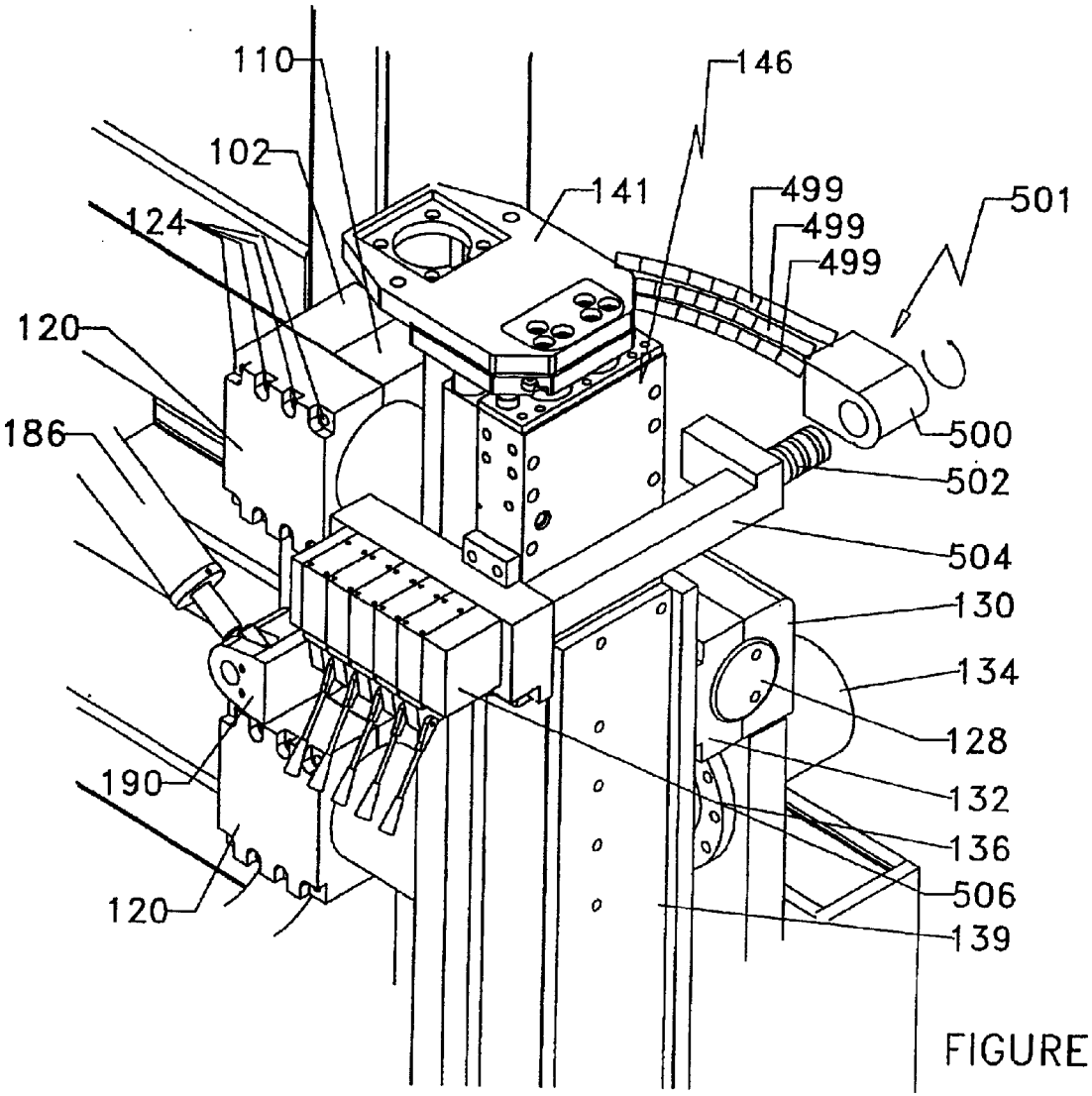
FIG. 28 illustrates a perspective view of a side positioned bolting rig, showing a rotary joint for the supply of operating fluids.

Illustrated in FIG. 28 is a perspective view of a partially assembled right side bolting rig 146. At the upper right hand corner of the rig 146 is a manifold block 500 which is connected by hoses 499 to water, the power pack 42 and its control system. The manifold 500 is received by a swivel joint 502, mounted onto a ported delivery block 504, which conducts fluids to and from the control valve block 506. The swivel joint 502 and manifold 500 together form a rotary joint which allows hydraulic fluid to power the bolting rig 146 and deliver water under pressure, as well as lead away return hydraulic fluid to the return oil tank 340 on the platform assembly 8. The rotary joint 501 which is made from the manifold 500 and swivel joint 502 will now be described with respect to FIGS. 29 to 37.

Referring now to FIGS. 29 to 37, the swivel pin 502 is made up of an annular member having a series of five annular grooves 510, 512, 514, 516, 518 which form passages when assembled with the manifold 500. The manifold receives five hoses, which respectively connect to and via five fittings 499A to communicate with five ports 510B, 512B, 514B, 516B, 518B. Each one of these five ports communicates to one of the annular passages 510, 512, 514, 156, 518.

Through the middle of the pin 502 is a series of five spaced apart longitudinally extending blind bores 510A, 512A, 514A, 516A, and 518A which have communicable passage through to the annular passages formed by grooves 510, 512, 514, 156, 518 respectively, via a corresponding slot or bore which is formed in a radial or similar direction through the base of the grooves 510, 512, 514, 516, 518.

The manifold 500 includes at six locations corresponding to each of the end or divider annuli 520, 522, 524, 526, 528, 530 on the pin 502, when assembled together, a corresponding ring seal 113 or other type of rotating seal. In this way, any fluid passing through any one of the hoses and inlet pipes coming into the manifold 500, will pass through just one passage through to the ported delivery block 504 and ultimately on to the control valve block 506, and in the reverse direction for fluids exiting control valve block 506.

The sizes of the annular passages 510, 512, 514, 516, 518 are determined according to the flows and pressures of fluid to pass there through.

The pin 502 and manifold 500 are rotatably secured together once the manifold 500 is correctly positioned over the swivel pin 502, by a circlip 540 being positioned into an annular groove 542.

The annular passage 510, and blind bore 510A preferably communicates from the control valve block 506 to return hydraulic fluid back to the return tank 344.

The annular passage 512, and blind bore 512A preferably communicates hydraulic fluid and pressure from the power pack 42 to slide extension valve to extend or retract the cylinders 114, 118, (on the right side of assembly 24) on the control valve block 506.

The annular passage 514, and blind bore 514A preferably communicates from the control valve block 506 a pressure signal via hydraulic pressure to the power pack 42 control system to indicate the amount of pressure needed to be supplied by the power pack 42.

The annular passage 516, and blind bore 516A preferably communicates water under pressure from water tanks on the platform assembly 8 to water valve on the control valve block 506.

The annular passage 518, and blind bore 518A preferably communicates hydraulic fluid and pressure from the power pack 42 to other drilling and positioning functions and control valves via the control valve block 506.

Figure 38:
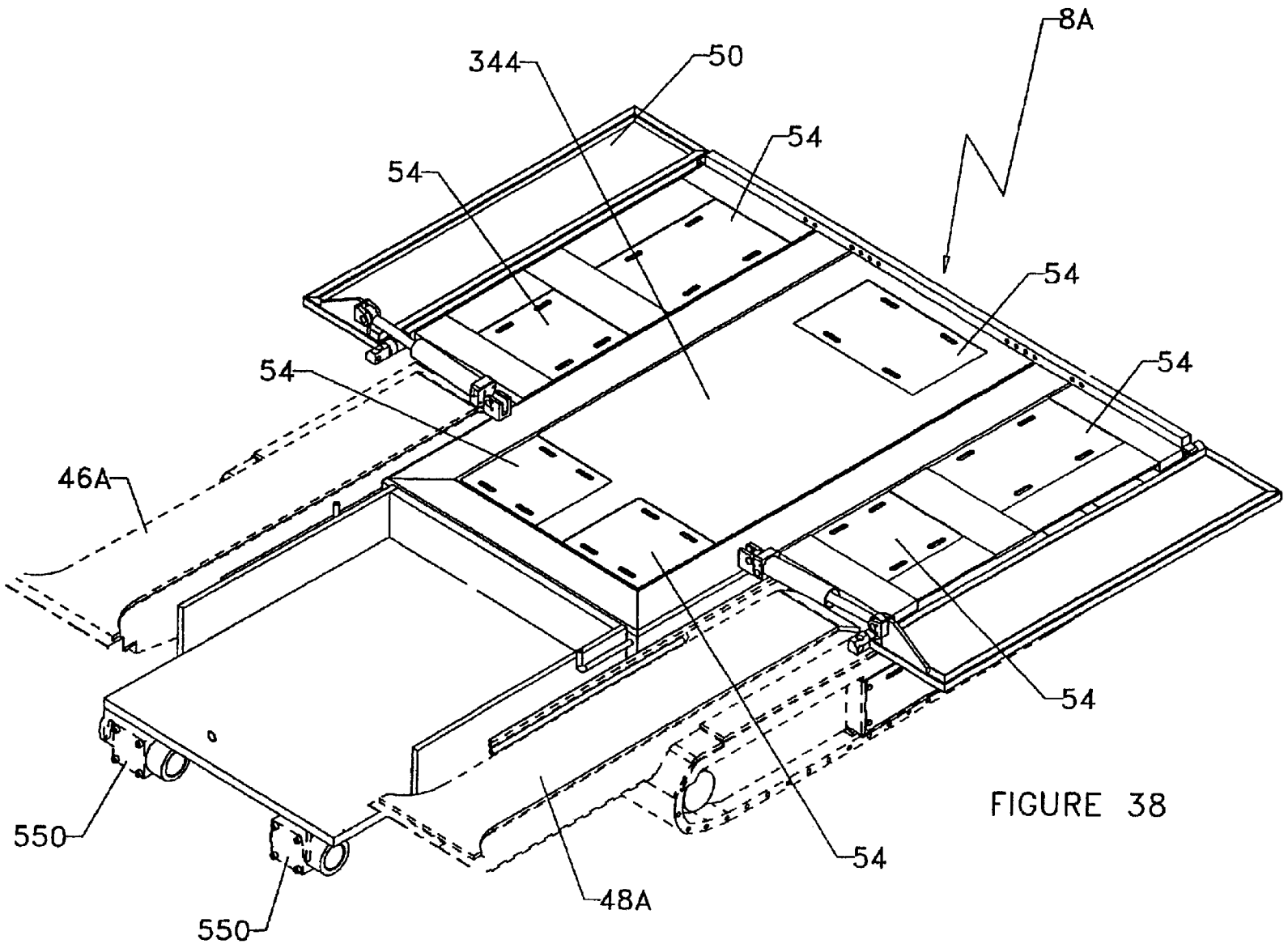
FIG. 38 illustrates a perspective view of a platform of an alternative embodiment of the invention.

Illustrated in FIG. 38 is a perspective view of a platform assembly 8A which is a modified platform assembly to that of other figures. In the embodiment which utilises this platform assembly 8A, the power pack 42 and the materials pod 46, and the materials pod 48 of FIG. 1 are mounted directly onto the track units 4 and 6, and would occupy the areas 46A and 48A in FIG. 32. The platform assembly 8A is pivoted by means of a single pivot bar (not illustrated) extending between the two beams 12 of the respective track units 4 and 6, via the clevis formed by the bored blocks 550. The platform assembly 8A includes all the other features provided in the platform assembly 8 of other figures. However, during raising and lowering procedures the power pack 42 and materials pod 46 and 48 remain stationery, thus decreasing the amount of power required of the cylinders 36 to raise the platform assembly 8A.

While this will mean that the pods 46 and 48 will not be maintained at the same level at all times for the operator to access, in most use applications it is expected that it will cause little to no inconvenience in return for the ability to keep the platform assembly 8A stable at all times even if pods 46 or 48 are being exchanged by an LHD.

Referring now to the FIGS. 39 to 43 which illustrate another embodiment of the invention. Features in FIG. 39 to 43 which are alike with features in FIGS. 1 to 9 have been numbered with the same numeral followed by the letter "C", for convenience and to enhance the clarity of the drawing not all the features referenced in FIGS. 1 to 9 are referenced in FIG. 39 to 43.

Figure 39:
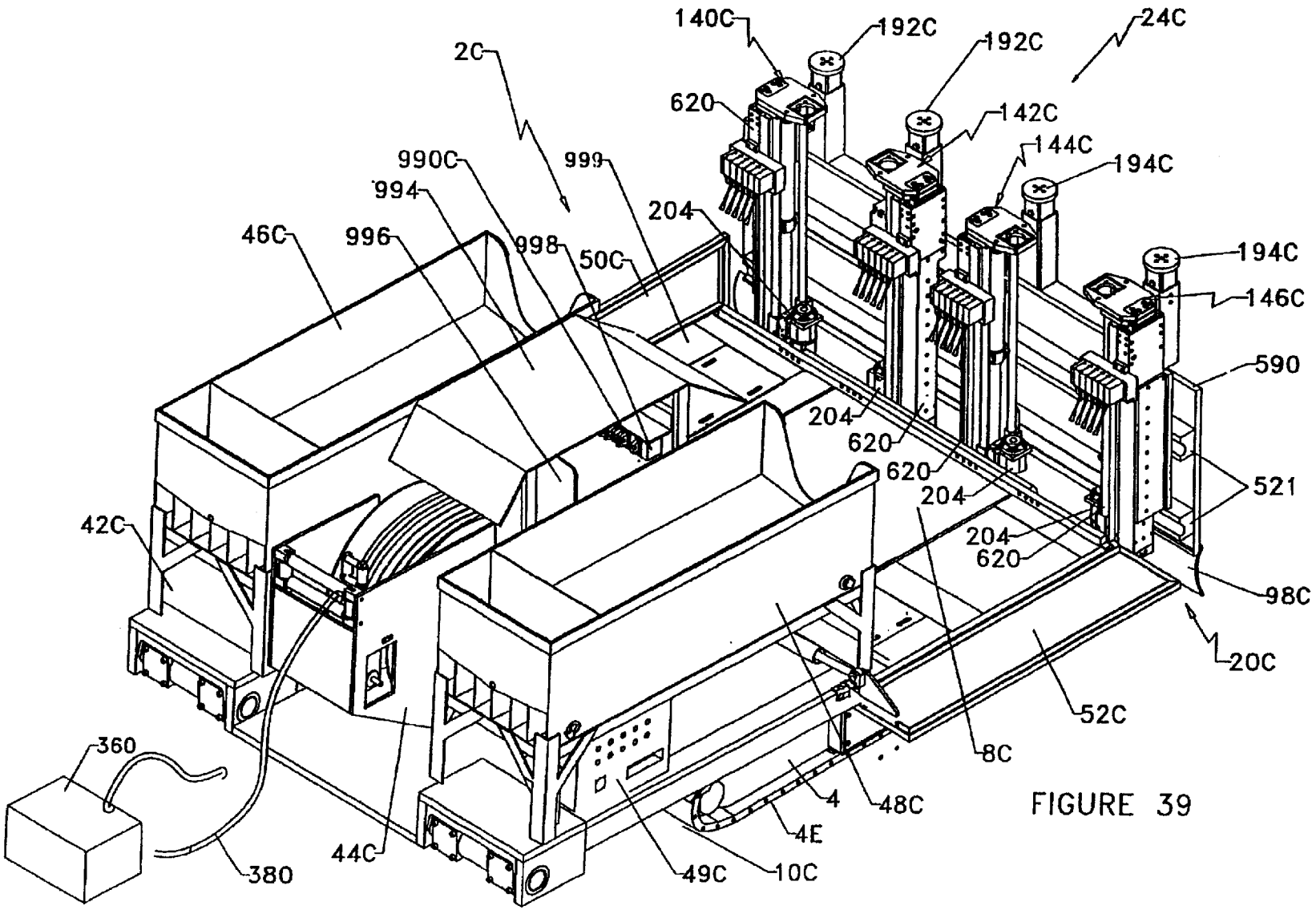
FIG. 39 is a perspective view of a preferred mobile bolting apparatus of the present invention.

FIGS. 39 to 43 illustrate a mobile bolting apparatus 2C in a mine entry 900 that has a roof 920 and a floor 940 and two sides or ribs 960. As can be seen in FIG. 39, the mobile bolting apparatus 2C of the present invention includes a platform assembly 8C that has a forward end 20, a rearward end 20A and two lateral sides.

As can be seen in FIGS. 39 to 43, the platform assembly 8C is mounted on two drive assemblies 4C, 6C in the same manner as that of FIGS. 1 to 9. Preferably, each drive assembly 4C, 6C includes an endless driven track or "cat" 4D, 6D for propelling the apparatus along the entry floor 940. The use of endless driven tracks for propelling vehicles within mine entries is well known in the art. However, other drive arrangements such as driven wheels, etc. could be employed. It will be further appreciated that the frame could be mounted on skids and advanced and retrieved by apparatus located remote from the mine face.

The drive assemblies 4C, 6C and various other components on the apparatus preferably obtain power from a power source generally designated as 360 that is generally located remote from the newly developing entry 900. A power cable 380 extends from the power source and is stored on a conventional cable reel 44C that is operably mounted on the platform assembly 8C. The skilled artisan will appreciate that such cable reel arrangements are known in the art and serve to selectively store and pay out cable as the apparatus 2C advances into or retreats out of the entry 900.

In FIGS. 39 to 43, an upstanding bolter support 590 is attached to the forward end 24 of the platform assembly 8C. A plurality of (preferably four) convention bolters 140C, 142C, 144C, 146C are movably supported by the upstanding bolter support wall 590. The construction and operation of such bolters are well known in the art, however some improved bolters such as those identified below could be utilised. Such conventional bolter arrangements generally include a support mast 620 that has an extendable timber jack which terminates in a top plate 141. A timber jack top plate 141 is attached to the end of the timber jack as shown in the FIGS. 39 to 43. A drill head 204 which rotatably supports a conventional drill bit (not shown) is movably supported on the support mast 620 for selective movement therealong.

Figure 43:
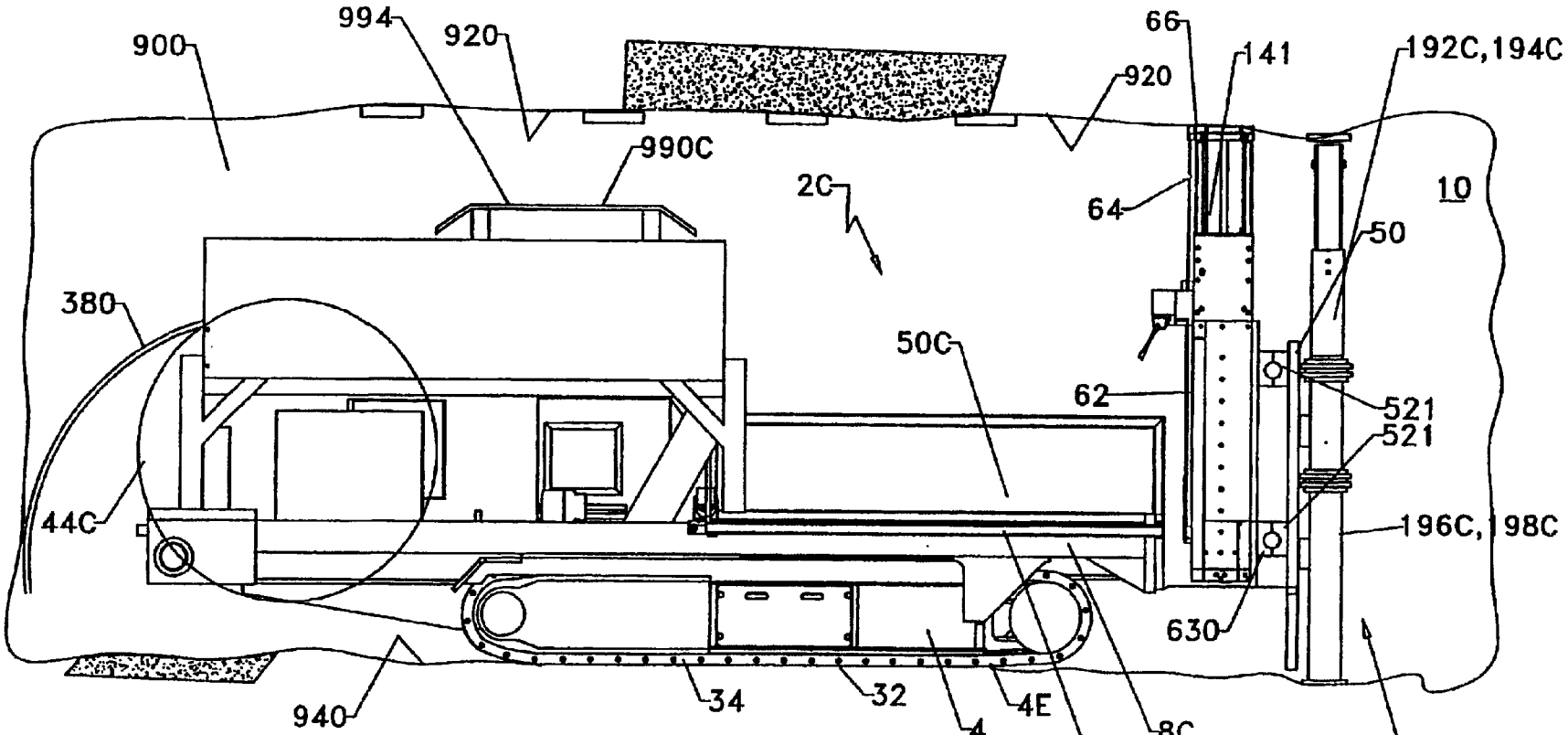
FIG. 43 is a side elevation of the mobile bolting apparatus and entry of FIG. 41 showing the roof support members and bolters in their extended positions for installing a bolt into the entry roof.

Each bolter 140C, 142C, 144C, 146C is preferably movably attached to the bolter support wall 590 by a slide arrangement to facilitate lateral positioning of the bolters 140C, 142C, 144C, 146C along a plane "A—A" that is substantially parallel to the bolter support wall 590. (see FIG. 40. A pair of slide rails 521 are preferably attached in spaced-apart relation to the bolter support wall 590 as shown in FIGS. 39 and 43. Each bolter mast 620 has a pair of support members 630 that are complementary shaped relative to the slide rails 521 and are received therein, (see FIG. 43). Such arrangements permit each mast 620 to be selectively movably positioned along line A—A of FIG. 40. A lock or other mechanism (not shown) corresponding to each mast 620 is employed to lock each mast 620 in position after it has been moved to a desired position. Preferably each mast 620 is moved by a hydraulic cylinder or other hydraulic means and the masts 620 are locked into a position by hydraulic valve means.

To support the roof 920 during the bolting operation, a pair of conventional temporary roof support assemblies 192C and 194C are preferably employed. The construction and operation of such temporary roof support assemblies for use in connection with the installation of roof bolts are well known in the art. Therefore, the construction of the roof support assemblies 192C and 194C will not be discussed in great detail herein.

As can be seen in FIGS. 39 to 43, a preferred roof support assembly 192C and 194C includes a hydraulically actuated cylinder arrangement. Two downwardly directed stab jacks 196C and 198C are also included to engage the floor of the mine 940. The stab jacks 196C and 198C can be selectively brought into engagement with the entry floor 940 and jacks 192C and 194C can be brought into engagement with the entry roof 920 to form a continuous load bearing column therebetween. Support plates 200 and 202 are attached to the lower end of stab jacks 196C and 198C to better distribute the load to the entry floor. In a preferred embodiment, the jacks 192C and 194C include a cross bar that has a two upwardly extending support plates attached thereto, to engage a larger area of the roof 920.

As can be seen in FIGS. 39 to 43, an operator's station 990 is located on the platform assembly 8C remote from the bolters 140C, 142C, 144C, 146C and roof support members 192C and 194C. Preferably, the operator's station is located approximately 2 meters away from any of the roof support members 192C and 194C to define a work area, generally designated as 999, therebetween. The skilled artisan will readily appreciate that such arrangement enables the operator to be located under a portion of the entry roof that has been bolted when the temporary roof cylinders 192C and 194C are brought into engagement with a yet unsupported portion of the entry roof, (see FIG. 43).

Operator's station 990 is provided with a roof canopy 994 for protecting the operator from debris falling from the entry roof 920 and is preferably equipped with an operator seat 996 and controls 998 for controlling the operation of the drives 4C, 6C and the roof support members 192C and 194C. In addition, the bolters 140C, 142C, 144C, 146C, may be controlled from the operator's station.

The exposed portion of the platform assembly 8C is covered by a planar deck such as that known as checker plate or it may be expanded metal mesh. Either or both of these can be attached to the platform and serves to define a support platform upon which the operating personnel can walk. In a preferred embodiment, laterally extending deck extensions 50C and 52C are pivotally attached to the forward lateral sides of the platform assembly 8C adjacent the forward end of the frame as shown in FIGS. 39 and 43. Deck extensions 50C and 52C are preferably adapted to be selectively pivoted between a first extended position wherein they are substantially coplanar with the deck of the platform assembly BC to a second vertically oriented storage position. In FIGS. 39, 40, 41 and 43 the deck extension 50C is illustrated in a retracted position, while deck extension 52C is an extended position. In a preferred embodiment, each deck extension is pivoted by either a rotary actuator or a hydraulic cylinder.

Figure 40:
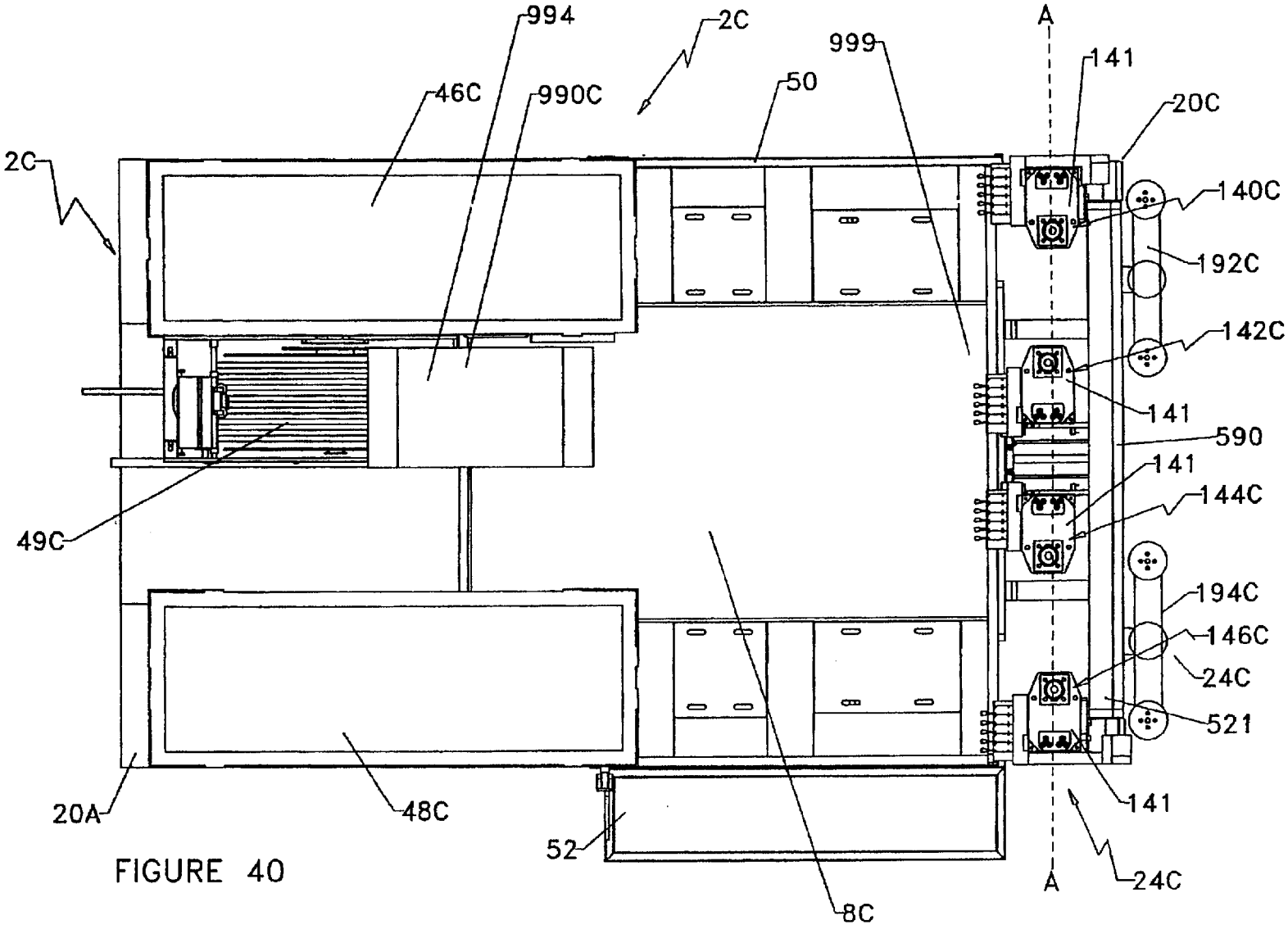
FIG. 40 is a plan view of the preferred mobile bolting apparatus of FIG. 39.

Also in this embodiment, storage containers 46 and 48 are removably mounted to the platform assembly 8C. Those of ordinary skill in the art will appreciate that such storage containers can be used to store bolts, plates and various other pieces of equipment and tools. As can be seen in FIG. 40, a portion of the platform assembly 8C is adjacent to one lateral side of one of the storage containers to afford an operator easy access to its contents. The contents of the other storage container 46C can easily be access from its one end.

In addition a push blade 98C is preferably affixed to the forward end of the platform assembly 8C to enable debris and rock that has fallen into the entry to be pushed to a location wherein it does not obstruct free movement within the entry by various vehicles and personnel.

A preferred method will now be described of utilising the mobile bolting apparatus 2C.

After a mining machine has formed a portion of an entry extension, the mining process is interrupted and the mining machine and supporting conveying apparatus is moved to enable the mobile bolting apparatus 2C to be driven into the entry 900. The mobile bolting apparatus 2C is controlled by one of two operators seated in the operator's station 990 and is driven into the entry 900 by drives 4C, 6C. Those of ordinary skill in the art will appreciate that the cable 380 is affixed to the power source 360 (see FIG. 39) to provide the mobile bolting apparatus 2C with the requisite power.

The mobile bolting apparatus 2C is driven to a point wherein it is located directly beneath a portion of entry roof 920 that is to be initially bolted. Thereafter, the temporary roof support members 192C, 194C are extended to engage the roof 920 and support member 196C and 198C extend to engage floor 940 of the entry 900 to provide a two load bearing columns therebetween.

It will be appreciate that when the temporary roof support cylinders 192C, 194C, 196C and 198C are extended in this manner, the operators are located under the protective canopy of the operator's station 990.

Figure 41:
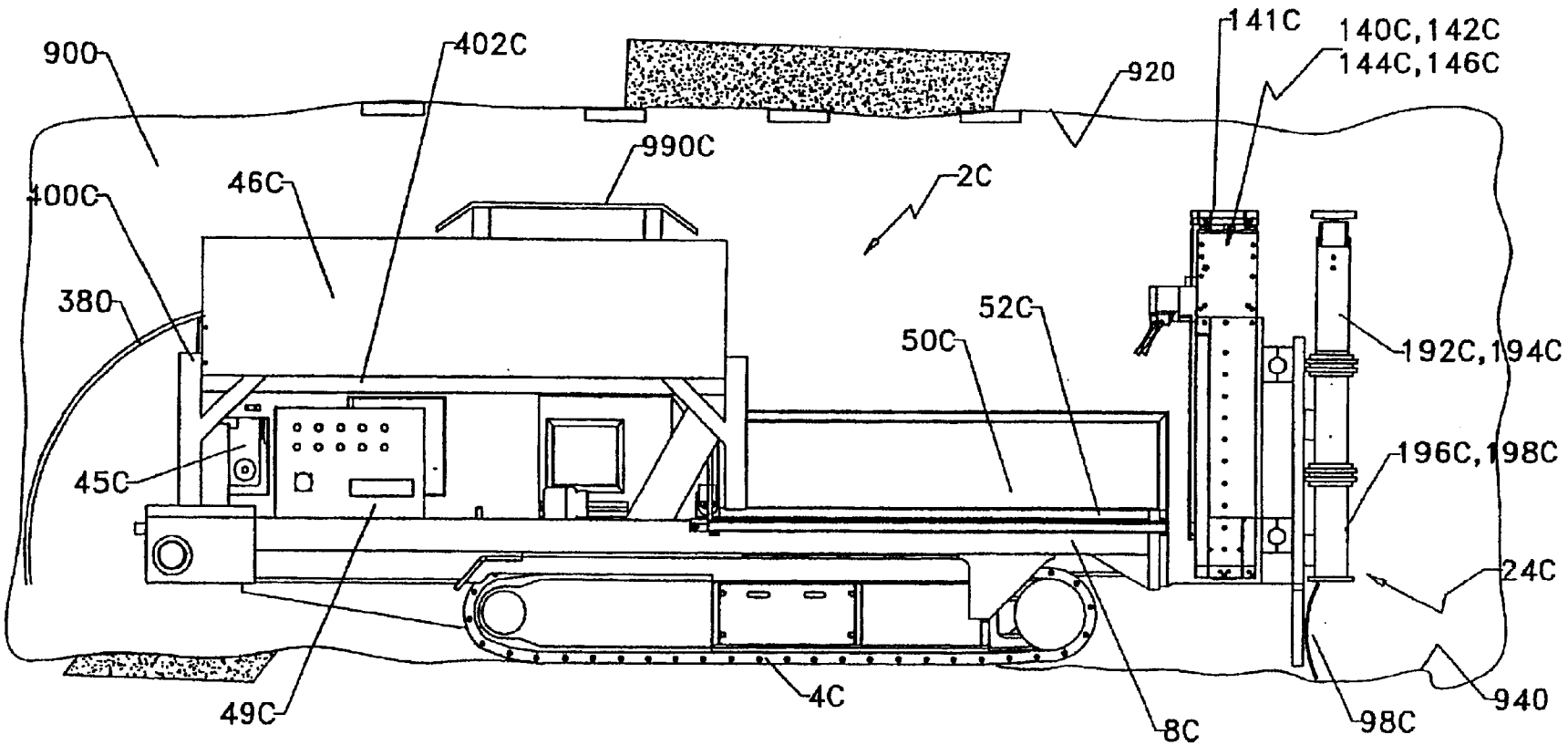
FIG. 41 is a side view of the mobile bolting apparatus of FIGS. 39 and 40 in a mine which is shown in cross section.
Figure 42:
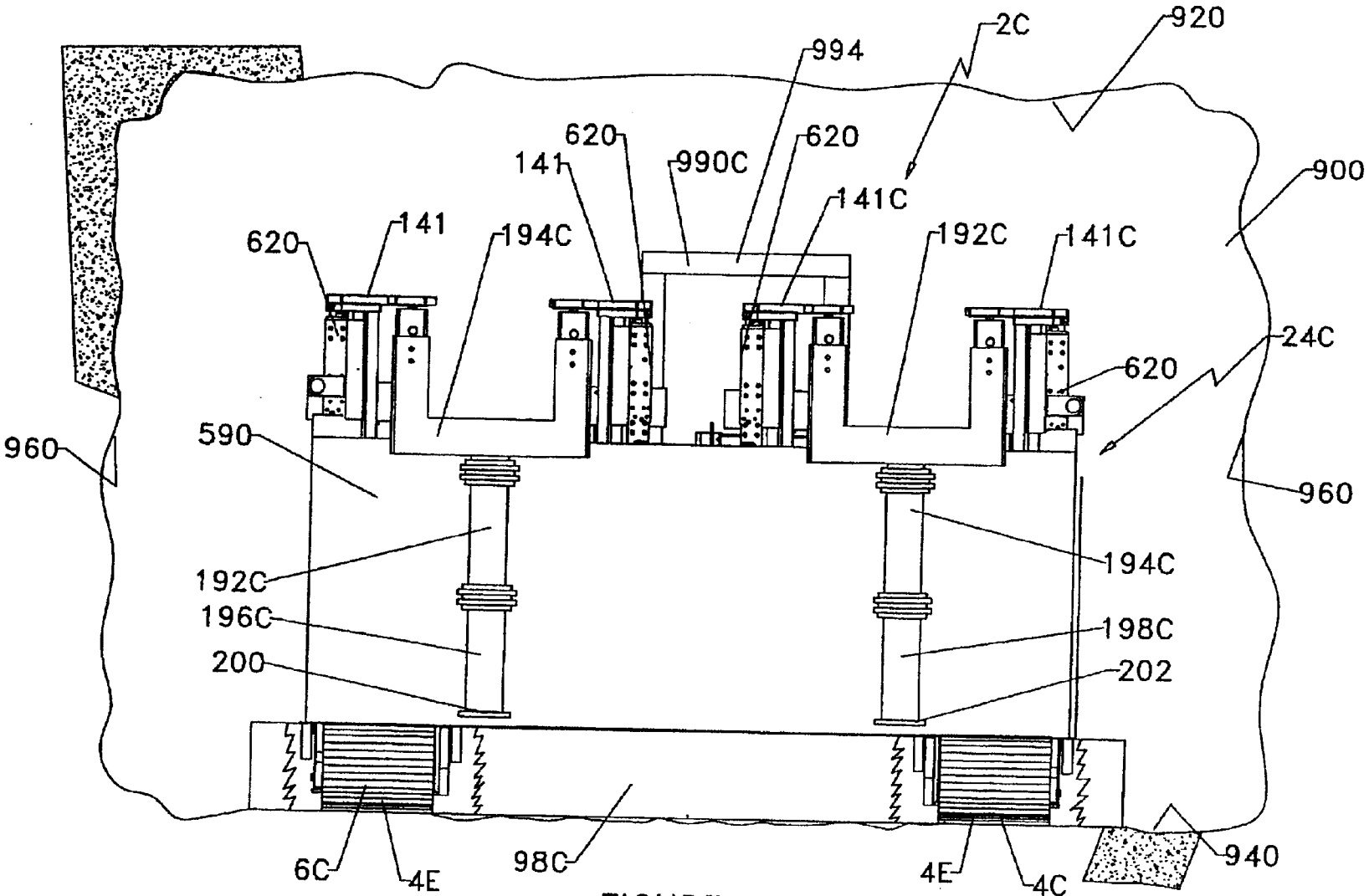
FIG. 42 is a front view of the mobile bolting apparatus of FIGS. 39 to 41 in an entry (shown in cross-section) with the bolters and roof support members in their inactivated positions.

After the temporary roof cylinders 192C, 194C, 196C, 198C have been installed, the operator can then walk across the platform assembly 8C to the bolters 140C, 142C, 144C and 146C. The bolters 140C, 142C, 144C, 146C are then activated to install bolts in the entry roof 920 in a known manner. After the bolts have been installed and the bolters 140C, 142C, 144C, 146C are returned to inactivated positions, (as illustrated in FIG. 41) the operators return to the operator's station 990 and the temporary roof support members 192C, 194C, 196C, 198C are retracted to permit the mobile bolting apparatus 2C to be driven forward to the next position wherein additional bolts are to be installed.

The above described embodiments all disclose a row, or in line arrangement, of bolting rigs mounted on an extendible frame, attached directly to the platform assembly. Prior art bolting equipment which mounts the bolting rigs onto swinging booms, are dangerous in that they produce lethal crushing points. The arrangement of frame and platform of the bolter 2 prevents such dangerous conditions.

One advantage of the material pod 46 is that bolts and other consumables need only be handled individually once when loading them into the pods 46, and then once by the operators during installation. This system eliminates the double handling of the consumables that occurs on prior art bolters. The ability to provide the pod system on the structure of the bolter 2 arises because the platform assembly provides a relatively large work space, giving sufficient space for such a system.

Another advantage of the provision of a large platform space is the ability to build into the underfloor area, hydraulic oil tanks and return oil tanks into the area beneath the platform, as part of the platform. This means that valuable deck space is not obstructed, and hoses are minimised as returns go straight into the platform tanks.

Because the tank is relatively shallow with an expansive upper and lower surface area, there is both top and bottom, relatively large cooling surfaces to cool the oil. When water is used in drilling, the water falling on or hitting these surfaces helps to further cool the oil.

The pivoting platform's construction ensures that on inclined roadways of 0° to 3° incline or 0° to 2° decline to the horizontal, the whole platform assembly, and the bolting rig assembly can be positioned in the horizontal, reducing the amount of tilting required per bolting rig. Thus making the bolting process speedier in these situations.

The provision of a large work space ensures that the operators have sufficient area to manoeuvre bolts around the platform without interrupting each other, but also sufficient room for the operators to safely escape wet zones which may be produced if water is being used during drilling.

While the above description refers to bolting rigs, the rigs may be used for coring, or drilling purposes along, without installation of bolts.

Further, the bolting rigs described above are referred to as having rotational units, but such units may be percussive alone, or a combination of rotational and percussive units.

While one of the main features disclosed in the above description is the provision of a platform assembly pivoted at the rear, and while this feature does provide many advantages, it can be replaced by other mechanisms for lifting, such as the pantographic type, scissor type, or direct hydraulic lift. However, with the pantographic or scissor types, as the platform assembly will remain parallel to the track units, additional inbye and outbye tilting may be needed on the central bolting rigs. Without a pivoted connection, levelling of each individual rig would need to occur. On the other hand one advantage of using four direct hydraulic lifting units at four locations on the platform a variety of pitch and yaw angles could be achieved.

In all of the above described embodiments, the bolting rigs 140, 142, 144 and 146 are preferably of the sort as disclosed in pending application 34200/97 which is to be published on or about Feb. 8, 1998, or corresponding application U.S. Ser. No. 08/908,464. The rigs disclosed in these documents are preferred as they offer significant advantages compared to other bolting rigs. However, it will be understood that any appropriate bolting rig could be utilised with the embodiments of this invention.

The above invention is disclosed with respect to a bolter 2, having some four bolting rigs mounted thereon. However, the combination of the platform assembly 8C and track units 4, 6 together with any number of bolting rigs (1, 2, 3, 4, 5 etc) with the one, or one or more outside positioned rigs thereof being able to rotate to perform both rib bolting and roof bolting is an embodiment which is within the scope of the invention disclosed herein.

It will be understood that while the above description of the embodiments only illustrates track units having endless driven tracks, that the mechanism for propelling the assembled vehicle could be any appropriate means such as drive wheels etc. It will be further appreciated that for those the inventions not containing features relating to the means for propelling the vehicle, or for those directed solely to the features of the bolting rigs or the bolting rig assembly may be mounted on skids and advanced and retrieved by apparatus located remote from the mine face.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. Apparatus for installing bolts into a mine entry, said apparatus including: a frame having a forward end, a rearward end and lateral sides; at least one bolting rig, means for coperatively mounting said at least one bolting rig to said forward end of said frame; at least one roof support member separate from said bolting rig; and an operator station on said frame for supporting an operator thereon during operation of said at least one bolting rig, wherein said at least one roof support member is attached to said means for mounting said bolting rig to said forward end of said frame, and said at least one roof support member includes a dual acting hydraulic cyclinder arranged to engage said roof and floor of said entry and extend there between for selectively supporting said mine entry as bolts are installed therein and retain said frame in position during operation of said bolting rig.

2. A mining apparatus as claimed in claim 1 which further includes: a pair of drive units on opposite sides of the frame for carrying and moving the frame; a pivot assembly connecting the rearward end of the frame to each of the drive units, the pivot assembly defining a pivot axis which is generally horizontal, the frame being pivotable relative to said drives about said pivot axis; the at least one bolting rig adapted to be raised and lowered by pivoting the frame relative to the drive units about the pivot axis.

3. A mining apparatus as claimed in claim 1, which further includes in a line across said apparatus at least one central bolting rig and at least two side bolting rigs on opposite sides of the central bolting rig, the side bolting rigs being rotatable from a generally vertical orientation through a range of intermediate orientations to a generally horizontal outwardly facing orientation which allows for both roof and rib bolting by the side bolting rigs.

4. A mining apparatus as claimed in claim 3 wherein the side bolting rigs are mounted on opposed laterally extendible frames.

5. A mining apparatus as claimed in claim 4 wherein each said laterally extendible frame includes a laterally extendible telescoping cylinder for moving each said side bolting rig.

6. A mining apparatus as claimed in claim 4 which includes a pair of side by side central bolting rigs each of which is independently rotatable between inclined and vertical positions.

7. A mining apparatus as claimed in claim 1, wherein the apparatus further includes at least one removable storage container supported on said frame.

8. A mining apparatus as claimed in claim 1, further including at least one deck extension platform pivotally attached to at least one said lateral side of said frame and being pivotable from a first position wherein each said deck extension protrudes laterally from said corresponding lateral side and is generally coplanar therewith and a second generally upright position.

9. A mining apparatus as claimed in claim 8 wherein each said deck extension platform is pivoted between said first position and said second position by at least one hydraulic cylinder.

10. A mining apparatus as claimed in claim 9 wherein the frame has a push blade operably attached to the forward end thereof.

11. A mining apparatus as claimed in claim 1, wherein said bolting rig is able to rotate through a range of angles from approximately 10° in an inward direction from vertical, through angles from the vertical to the horizontal, to approximately 20° below the horizontal, so that the included angle in the range is approximately 120°.

12. A mining apparatus as claimed in claim 1, wherein said operator station being located at a position remote from said at least one bolting rig to define a work area therebetween, and a planar deck member attached to said frame and covering said work area for supporting an operator thereon.

13. A mining apparatus as claimed in claim 12 therein said operator station is at least 1.5 meters away from said at least one support member.

14. A mining apparatus as claimed in claim 1, further including a cable reel operably attached to said frame for selectively storing and paying out power cable attached between said apparatus and a power source.

15. A mining apparatus as claimed in claim 1, wherein said at least one bolting rig is pivotable between a generally vertical position and a generally horizontal position and wherein said bolting rig can install bolts into a rock face in either of those two positions and in any selected intermediate position therebetween.

16. A mining apparatus as claimed in claim 1, wherein said frame carries, at its forward end, an upstanding bolting rig support wall, a guide frame being mounted to said support wall, said bolting rig being movably supported on said guide frame and adapted to be selectively moved laterally along said guide frame parallel to said support wall.

17. A mining apparatus as claimed in claim 1 wherein each bolting rig has a control station associated therewith and is independently operable by means of said control station.

* * * * *